US008826569B2

(12) United States Patent
Grott et al.

(10) Patent No.: US 8,826,569 B2
(45) Date of Patent: Sep. 9, 2014

(54) INJECTED FOOTWEAR BOARD AND METHOD FOR MAKING THE SAME

(75) Inventors: Marco Aurelio Grott, San Marcos, CA (US); Gerald Kuhtz, Encinitas, CA (US); David Ortley, Encinitas, CA (US); Ernie Rustam, Oceanside, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 582 days.

(21) Appl. No.: 12/949,662

(22) Filed: Nov. 18, 2010

(65) Prior Publication Data

US 2011/0146108 A1 Jun. 23, 2011

Related U.S. Application Data

(60) Provisional application No. 61/289,852, filed on Dec. 23, 2009.

(51) Int. Cl.

| | |
|---|---|
| ***A43B 5/00*** | (2006.01) |
| ***A43C 15/16*** | (2006.01) |
| ***A43B 5/06*** | (2006.01) |
| ***A43B 13/42*** | (2006.01) |
| ***A43B 13/12*** | (2006.01) |
| ***A43B 13/26*** | (2006.01) |

(52) U.S. Cl.

CPC ..... *A43B 5/001* (2013.01); *A43C 15/16* (2013.01); *A43B 5/06* (2013.01); *A43B 13/42* (2013.01); *A43B 13/12* (2013.01); *A43B 13/26* (2013.01)

USPC ..... 36/127; 36/67 R; 36/134

(58) Field of Classification Search

USPC ..... 36/127, 67 R, 134, 107, 108, 128, 129, 36/67 A

See application file for complete search history.

(56) References Cited

U.S. PATENT DOCUMENTS

| | | | | |
|---|---|---|---|---|
| 3,735,507 | A * | 5/1973 | Granger | 36/59 R |
| 4,561,197 | A * | 12/1985 | Misevich | 36/127 |
| 4,837,949 | A | 6/1989 | Dufour | |
| 5,024,007 | A | 6/1991 | DuFour | |
| 5,052,130 | A | 10/1991 | Barry et al. | |
| 6,161,315 | A * | 12/2000 | Dalton | 36/134 |
| 6,438,873 | B1 | 8/2002 | Gebhard et al. | |
| 7,010,867 | B2 * | 3/2006 | Brown | 36/12 |
| 7,143,530 | B2 * | 12/2006 | Hudson et al. | 36/128 |
| 2006/0137228 | A1 | 6/2006 | Kubo et al. | |
| 2009/0145004 | A1 * | 6/2009 | Jones | 36/88 |
| 2009/0235558 | A1 * | 9/2009 | Auger et al. | 36/30 R |
| 2010/0229423 | A1 | 9/2010 | Lin | |

FOREIGN PATENT DOCUMENTS

| | | | |
|---|---|---|---|
| EP | 0272082 | B1 | 8/1992 |

* cited by examiner

*Primary Examiner* — Ted Kavanaugh

(74) *Attorney, Agent, or Firm* — Klarquist Sparkman, LLP

(57) ABSTRACT

A golf shoe includes a sole member integrally formed with a molding material, a structural member, and a plurality of receptacles in the bottom of the sole member. The structural member extends along at least a portion of the length of the sole member and is configured to not vertically overlap with any of the receptacles. A method of manufacturing a shoe with a sole member that has a structural member formed integrally therewith is also provided.

27 Claims, 22 Drawing Sheets

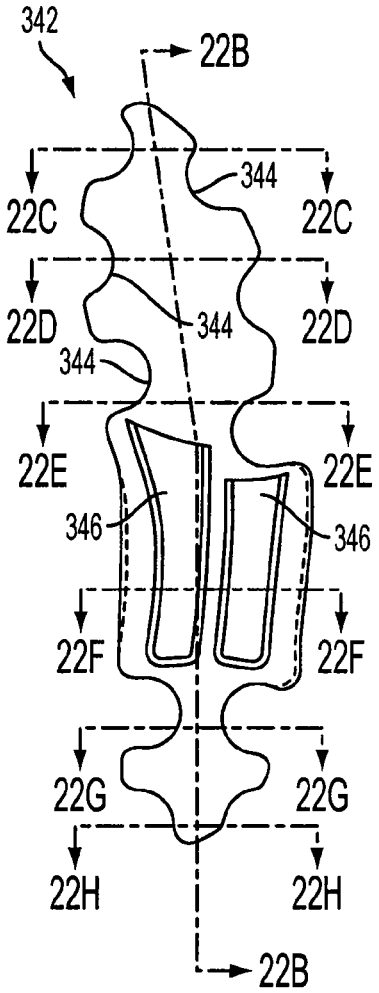
FIG. 22A
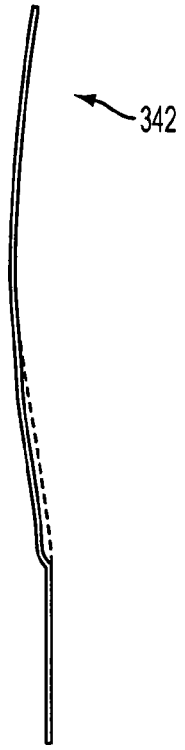
FIG. 22B
FIG. 22C
FIG. 22D
FIG. 22E
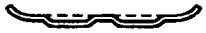
FIG. 22F
FIG. 22G
FIG. 22H

INJECTED FOOTWEAR BOARD AND METHOD FOR MAKING THE SAME

CROSS REFERENCE TO RELATED APPLICATION

This application is a non-provisional application claiming priority to and benefit of U.S. Provisional Patent Application No. 61/289,852, filed Dec. 23, 2009, which is incorporated herein by reference.

FIELD

This disclosure pertains to a sole member of a shoe and a method of manufacturing the sole member. More specifically, this disclosure relates to a structural member integrated into a sole member for use with shoes and, in particular, golf shoes.

BACKGROUND

Golf shoes traditionally include a shoe upper, a lasting board, and an outsole. FIG. 1 illustrates a conventional method of constructing a shoe with these three basic components. As shown in FIG. 1, the lasting board, also called an insole board, is secured to a bottom portion of the upper and the bottom portion of the upper is adhered to the outsole.

Golf shoes constructed using conventional methods, such as the shoe shown in FIG. 1, exhibit several drawbacks. For example, the manufacturing process can be somewhat complicated since the upper must be attached to both the lasting board and the outsole. In addition, the bottom of the foot is often positioned higher off the ground than desired when using a conventional golf shoe. That is, since the foot must be positioned on or above the lasting board, which is, in turn, on or above the outsole, conventional golf shoes generally must be of a certain height profile. Improvements to the form, function, and manufacturing processes relating to golf shoes are always desirable, including those that facilitate the construction of a low-profile golf shoe.

SUMMARY

In a first embodiment, a golf shoe that has a sole member integrally formed with a molding material is provided. The sole member comprises a structural member, a molding material, and a plurality of receptacles in the bottom of the sole member. Each receptacle is configured to receive a cleat member. The structural member can extend along at least a portion of the length of the sole member and is can be configured to not vertically overlap with any of the receptacles. In particular implementations, the structural member comprises carbon fiber and/or a polyamide elastomer.

In other specific implementations, the structural member can comprise a plurality of openings that extend through the structural member. Each opening can be aligned with at least one receptacle. The structural member can also comprise a plurality of cut-away portions, with each cut-away portions being adjacent to, but not covering, at least one receptacle.

In other specific implementations, the structural member can comprise one or more grooved portions that extend longitudinally along at least a portion of the length of the shoe. The one or more grooved portions cause the structural member to have a 3-dimensional cross-sectional profile along its width at the areas of the one or more grooved portions. In specific implementations, the golf shoe can have at least two grooved portions.

In other specific implementations, the structural member can curve upward at its lateral and medial edges. For example, the structural member comprises at least one upwardly extending member that extends above an insole of the shoe to at least partially surround a foot of a person wearing the shoe. In specific implementations, the structural member can extend substantially the length of the sole member. Alternatively, the structural member can extend less than 75% of the length of the sole member. An upper can also be secured to a top portion of the sole member. In a specific implementation, at least a portion of the structural member can be exposed at the bottom of the sole member. The exposed portion of the structural member can comprise a bridging portion that extends between a heel portion and a forefoot portion.

In other specific implementations, the structural member can vary in thickness along its length. Alternatively, the structural member can be substantially constant in thickness along its length. In other specific implementations, the structural member bends or curves along at least a portion of its length. In specific implementations, the molding material can be a thermoplastic polyurethane.

In another embodiment, a method of manufacturing a golf shoe is provided. The method can include providing a structural member, inserting the structural member into a mold, injecting a molding material on or around the structural member to form a single integral sole member that comprises the molding material and structural member, removing the sole member from the mold, and constructing a golf shoe with the sole member.

In specific implementations, the act of injecting a molding material can include injecting a first molding material into the mold to form an intermediate sole member with the first molding material covering at least a portion of the bottom of the structural member and covering a top surface of the structural member, removing the intermediate sole member from the mold, inserting the intermediate sole member in another mold, and injecting a second molding material into the mold to form the sole member.

In other specific implementations, the method can further include positioning a plurality of receptacles in a bottom of the mold with each receptacle being configured to receive a cleat member, positioning the structural member in the mold so that one or more openings in the structural member are vertical aligned with the location of the receptacles, and holding each receptacle in position in the mold by extending one or more restraining members through the openings in the structural member.

In another specific implementation, the method can further include forming the structural member with one or more grooved portions that extend longitudinally along at least a portion of the length of the shoe. The one or more grooved portions can cause the structural member to have a 3-dimensional cross-sectional profile along its width at the areas of the one or more grooved portions to increase the rigidity of the structural member. In another specific implementation, the act of forming the structural member comprises forming at least two grooved portions.

In another specific implementation, the method can further include forming the structural member so that the structural member curves upwards at its lateral and medial edges. In another specific implementation, the method can further include forming the structural member with at least one upwardly extending member that extends above an insole of the shoe to at least partially surround a foot of a person wearing the shoe. The method can also include securing an upper to a top portion of the sole member.

In another specific implementation, the act of positioning the structural member in the mold comprises positioning the structural member in the mold so that at least a portion of the bottom of the structural member is not covered by the molding material. The portion of the structural member that is not covered by the molding material can be a bridging portion between a heel portion and forefoot portion.

In another embodiment, a sole member for use with a golf shoe is provided. The sole member includes a structural member and molding material. The structural member can extend along at least a portion of the length of the sole member and provide rigidity to the sole member. The molding material can at least partially surround the structural member. The molding material can form a heel portion and a forefoot portion of the sole member. The structural member can extend between the heel and forefoot portions to couple the heel and forefoot portions together.

In specific implementations, the structural member can comprise carbon fiber and/or a polyamide elastomer. In another specific implementation, a plurality of receptacles can be positioned on a bottom of the sole member with each receptacle being configured for receiving a cleat member. The structural member can comprise a plurality of openings that extend through the structural member and each opening can be vertically aligned with at least one receptacle.

The structural member can comprise a plurality of cut-away portions with each cut-away portions being adjacent to, but not vertically overlapping, at least one receptacle.

In another specific implementation, the structural member can comprise one or more grooved portions that extend longitudinally along at least a portion of the length of the shoe. The one or more grooved portions can the structural member to have a 3-dimensional cross-sectional profile along its width at the areas of the one or more grooved portions to increase the rigidity of the structural member. In addition, the structural member can curve upwards at a lateral and/or medial edge. The structural member can also comprise at least one upwardly extending member that extends above an upper surface of the molding material. The structural member extends substantially the length of the sole member or it can extend less than 75% of the length of the sole member.

In specific implementations, at least a portion of the structural member can be exposed at the bottom of the sole member. The structural member can vary in thickness along its length or it can be substantially constant in thickness along its length. The structural member can bend or curve along at least a portion of its length to increase the rigidity of the structural member. In a specific implementation, the molding material is a thermoplastic polyurethane.

The foregoing and other objects, features, and advantages of the disclosed embodiments will become more apparent from the following detailed description, which proceeds with reference to the accompanying figures.

BRIEF DESCRIPTION OF THE DRAWINGS

FIGS. 22A-22H are a plurality of views of the structural member of FIGS. 21A-21L.

DETAILED DESCRIPTION

Figure 1:
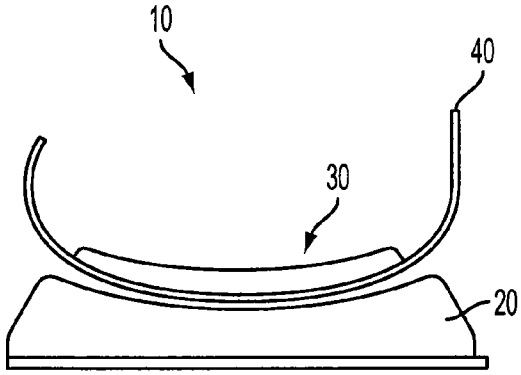
FIG. 1 PRIOR ART
FIG. 1 is a schematic view of a prior art construction of a conventional shoe.

The following description is exemplary in nature and is not intended to limit the scope, applicability, or configuration of the disclosed embodiments in any way. Various changes to the described embodiment may be made in the function and arrangement of the elements described herein without departing from the scope of the disclosure.

As used in this application and in the claims, the singular forms "a," "an," and "the" include the plural forms unless the context clearly dictates otherwise. Additionally, the term "includes" means "comprises."

Although the operations of exemplary embodiments of the disclosed method may be described in a particular, sequential order for convenient presentation, it should be understood that disclosed embodiments can encompass an order of operations other than the particular, sequential order disclosed. For example, operations described sequentially may in some cases be rearranged or performed concurrently. Further, descriptions and disclosures provided in association with one particular embodiment are not limited to that embodiment, and may be applied to any embodiment disclosed.

Moreover, for the sake of simplicity, the attached figures may not show the various ways (readily discernable, based on this disclosure, by one of ordinary skill in the art) in which the disclosed system, method, and apparatus can be used in combination with other systems, methods, and apparatuses. Additionally, the description sometimes uses terms such as "produce" or "provide" to describe the disclosed method. These terms are high-level abstractions of the actual operations that can be performed. The actual operations that correspond to these terms can vary depending on the particular implementation and are, based on this disclosure, readily discernible by one of ordinary skill in the art.

As shown and described in the embodiments herein, a sole member can comprise at least one molding material and a structural member (or board member) that preferably extends along at least a portion of the first molding material to enhance the rigidity of the sole member. The structural member preferably has a reduced cross-sectional profile to reduce the height profile of the shoe. In a preferred embodiment described herein, the structural member is preferably formed of a carbon fiber material, such as a fabric made of woven carbon filaments. However, other structural components can be used, so long as that material is of a greater rigidity than the molding material that forms the sole member along with the structural member. For example, the structural member can be formed of various polymers, such as thermoplastics (e.g., PEBAX®), polyamide elastomers (e.g., E-FLEX B1255A, E-FLEX B1260A, or E-FLEX B1270A, each of which is available from E-Polymers Co., Ltd.), thermosetting plastics, etc.

The molding material can comprise one or more of various natural or synthetic materials that are suitable for injection molding, including, for example, suitable thermoplastics, thermosets, and elastomers. In a preferred embodiment, the first material comprises thermoplastic polyurethane ("TPU"), which has a high degree of torsional rigidity.

FIG. 1 illustrates a schematic cross-sectional view of a conventional shoe 10 that has a sole member 20 and a lasting board 30. An upper member 40 is positioned between sole member 20 and lasting board 30 and three elements can be secured together to construct shoe 10.

As noted above, this construction exhibit several drawbacks compared to the novel methods and shoe constructions described below. For example, the construction process requires the assembly of at least three distinct elements, namely, sole member 20, lasting board 30, and upper member 40. In addition, such a method of assembly generally results in a shoe that has a height profile that is higher than desirable. Lowering the height profile of a shoe (e.g., the thickness between the outsole and insole of a shoe, which amounts to the distance that a wearer of the shoe is raised off the ground) can be particularly useful for certain types of shoes, including golf shoes. By lowering the profile of a golf shoe, the golfer is brought closer to the ground, which can improve overall balance, weight transfer, stability, power, and consistency of the golfer.

Figure 2:
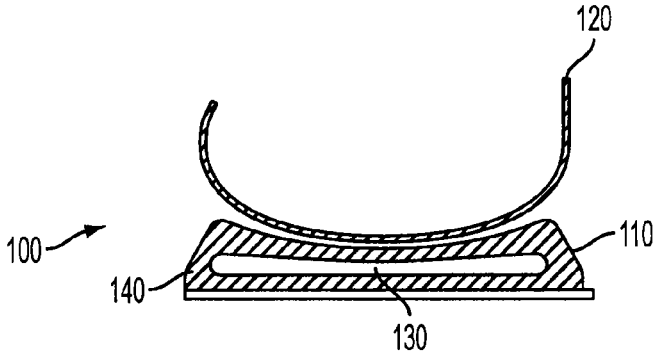
FIG. 2 is a cross-sectional view of a sole member comprising a molding material and a structural member.
Figure 3:
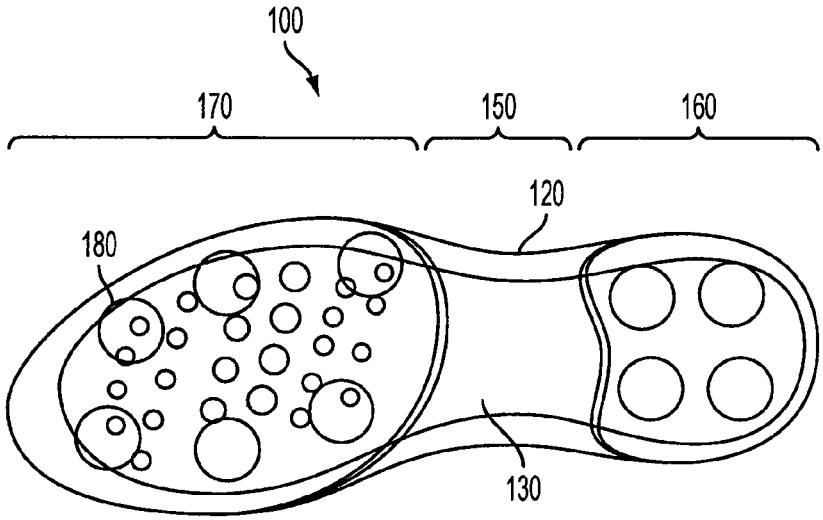
FIG. 3 is a bottom view of a shoe having a sole member formed of a molding material and a structural member.

FIGS. 2 and 3 show schematic illustrations of a novel shoe that comprises a sole member with an integrated structural member at least partially within an injection molding material. FIG. 2 is a cross-sectional view of a shoe 100, showing a sole member 110 comprising at least one structural member 130 integrated with a first molding material 140. An upper 120 can be coupled to the sole member 110 by any known method, including, for example, the use of an adhesive (glue) or stitching process.

FIG. 3 illustrates a bottom view of shoe 100. In the embodiment shown in FIG. 3 (and as described in more detail below), a portion of structural member 130 can be exposed at a bottom surface of shoe 100. As shown in FIG. 3, an exposed portion 150 can be located between a heel portion 160 and a forefoot portion 170. If desired, heel and forefoot portions can comprise receptacles 180 for receiving spikes or other gripping members. Such gripping members can be useful to provide the wearer with increased traction when the shoe 100 is worn during athletic endeavors, such as golf.

As described in more detail below, the structural members can vary in shape and size. For example, in some embodiments the thickness of the structural member can be substantially the same along its length and in others the thickness of the structural member can vary along its length. In addition, in some embodiments the structural member can be substantially flat and in others it can have a three-dimensional shape or profile. Various shapes and profiles of the structural member are described in the following embodiments. It should be understood that, unless it is contrary to the purpose of the structural member, the features of the following embodiments can be selected and combined with features of other embodiments. For example, an embodiment that shows a generally full-length structural member can be combined with an embodiment that shows a curved structural member to arrive at a full-length curved structural member.

FIGS. 4A-4F illustrate a structural member 200 that extends substantially the length of a sole member. As used herein, "substantially the length of the sole member" means that the structural member extends at least about 75% of the length of the sole member.

The sole member comprises structural member 200 and a first molding material (not shown). In this embodiment, the thickness of structural member 200 varies along its length. For example, at a heel portion 202, the thickness of structural member 200 can be about 3 mm, while at a toe portion 204, the thickness of structural member 200 can be less than about half of the thickness at the heel portion 202 (e.g., less than about 1.5 mm or, more preferably, about 1.0 mm).

Figure 4C:
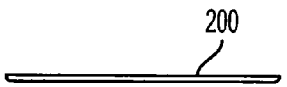
FIGS. 4A-4F are a plurality of views of an embodiment of a structural member for use in a sole member.
Figure 4D:
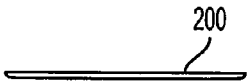
Figure 4E:
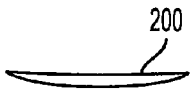
Figure 4F:
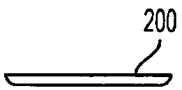
Figure 4B:
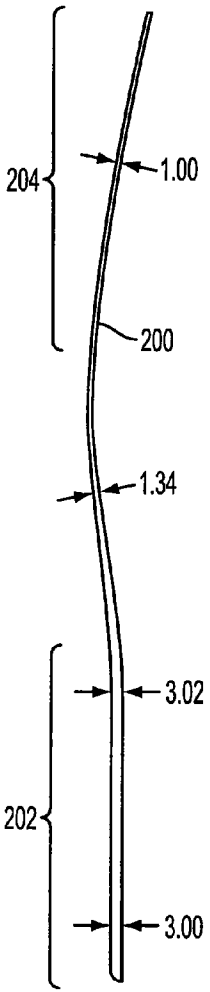
Figure 4A:
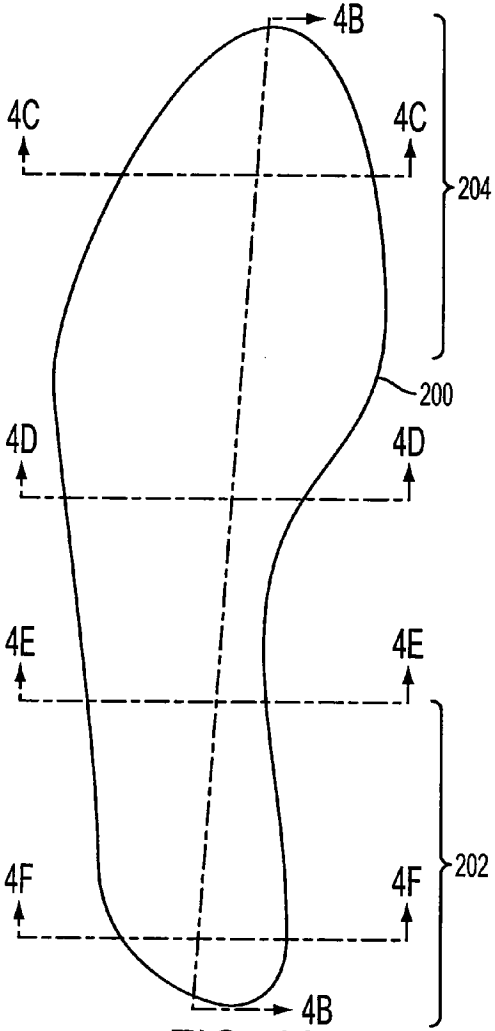

As shown in FIGS. 4E and 4F, portions of structural member 200 can be curved or otherwise have a 3-dimensional profile in cross section. This curvature can provide increased structural integrity to structural member 200. Conversely, in areas where less rigidity or strength is required or desired (such as in the toe portion 204), structural member 200 can be substantially flat in cross section (FIG. 4C).

Figure 5:
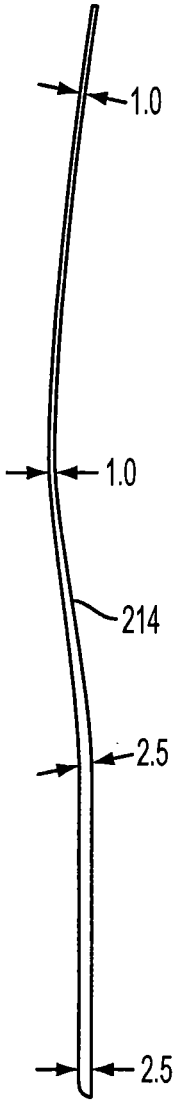
FIG. 5 is a side view of an embodiment of a structural member for use in a sole member.

FIG. 5 illustrates an embodiment similar to that of FIGS. 4A-4F, with a structural member 214 that has dimensions that are only slightly different from those of the previous embodiment. For example, structural member 214 varies in thickness from 2.5 mm at a heel portion to 1.0 mm at a forefoot portion.

Figure 6:
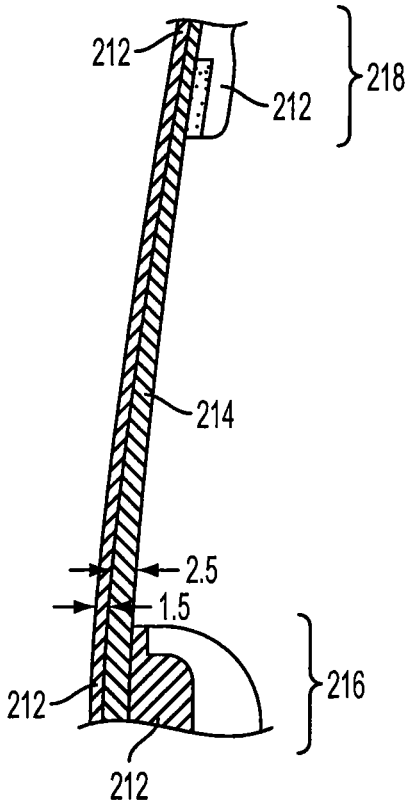
FIG. 6 is an expanded view of a cross-sectional area of a sole member having the structural member of FIG. 5.
Figure 7A:
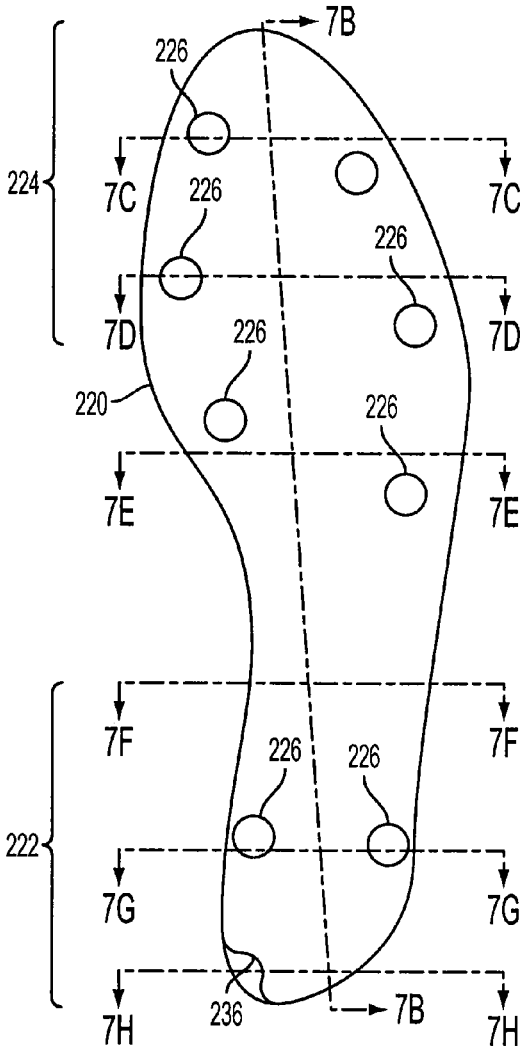
FIGS. 7A-7H are a plurality of views of an embodiment of a structural member for use in a sole member.
Figure 7B:
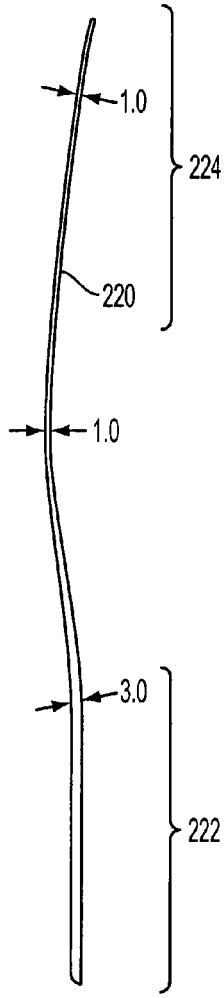
Figure 7C:
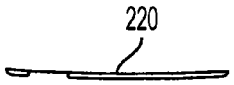
Figure 7D:
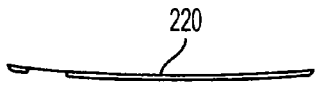
Figure 7E:
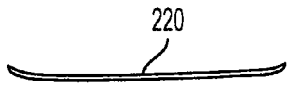
Figure 7F:
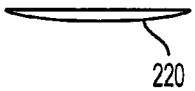
Figure 7G:
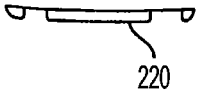
Figure 7H:
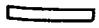

FIG. 6 illustrates a portion of a sole member 210 that comprises a first molding material 212 integrally formed with structural member 214. Structural member 214 bridges between a heel portion 216 and a forefoot portion 218. First molding material 212 can be injected above and below structural member 214 in the heel and forefoot portions 216, 218. In the area between those two portions, however, the first molding material 212 is preferably injected only above the structural member 214 (e.g., overmolded). Thus, the bottom of the structural member 214 is preferably exposed in the area between heel and forefoot portions 216, 218.

Figures 8A, 8B, 8C, 8D, 8E:
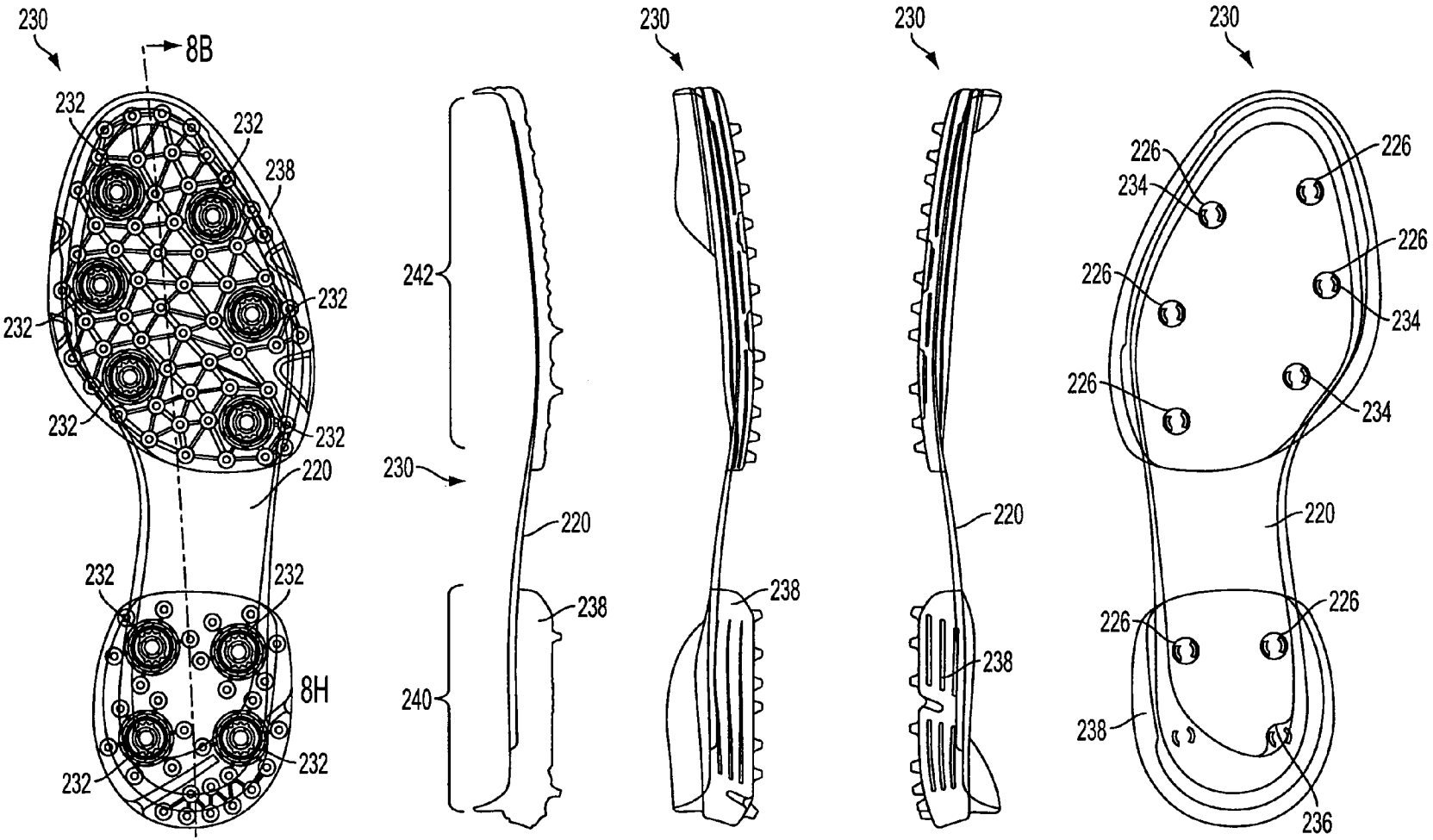
FIGS. 8A-8E are a plurality of views of an embodiment of a sole member having the structural member of FIGS. 7A-7H.

FIGS. 7A-7H illustrate another embodiment of a structural member. Structural member 220 generally extends substantially the length of the sole member (FIG. 8E). Structural member 220 varies from a thickness of about 3.0 mm in a heel portion 222 to less than half of that thickness (e.g., about 1.0 mm) in a forefoot portion 224.

Structural member 220 can also include a plurality of openings 226 that extend through structural member 220. As discussed above, golf shoes (and other athletic shoes) may include receptacles for receiving cleats or other gripping members. To facilitate the molding process, as discussed in more detail below, openings 226 are preferably aligned with the receptacles so that each opening 226 is located above the location of a receptacle.

FIGS. 8A-8E show structural member 220 incorporated into a sole member 230. FIG. 8A is a bottom view of sole member 230 which shows a plurality of receptacles 232 that are provided in the bottom of sole member 230 for receiving cleats or other gripping members. Receptacles 232 are preferably at least partially surrounded by a first molding material 238, which in combination with the structural member 220 form the sole member 230. As discussed below, the first molding material 238 is injected around receptacles 232 to secure the receptacles in sole member 230.

As shown in FIG. 8E, a top view of sole member 230, receptacles 232 can have a top (upwardly extending) portion 234. Each top portion 234 is preferably aligned with an opening 226 or a cut-away portion 236 of structural member 220. By aligning openings 226 with receptacles 232, the receptacles can be more easily molded into sole member 230. As discussed in more detail below, openings 226 facilitate the molding process by allowing pins (or other restraining members) to extend through openings 226 to hold the receptacles 232 in place during the molding process. Openings 226 also help facilitate a more complete bond between the molding material and the receptacles 232 by facilitating the flow of the first molding material 238 around receptacles 232.

Referring to FIG. 8B, structural member 220 extends substantially along the length of sole member 230. First molding material 238 can be injected beneath heel area 240 and forefoot area 242 of sole member 230. Structural member 220 can extend (or bridge) between heel and forefoot areas 240, 242, thereby coupling the two areas together. Preferably, the bridging portion of structural member 220 is exposed at a bottom surface of sole member 230. However, a layer of first molding material 238 can cover the bottom surface of the bridging portion of structural member 220 if desired.

Structural member 220 can be overmolded to further secure structural member 220 to the first molding material 238 and/or to provide a better surface for adhering an upper to the sole member 230. For example, if the structural member comprises carbon fiber and the upper comprises leather, it may be desirable to overmold the carbon fiber structural member so that the leather upper can be adhered to the first molding material instead of exposed carbon fiber. Alternatively, if the molding material is a synthetic material, it may not be necessary and/or desirable to overmold the carbon fiber to improve the adhesion properties of the upper to the sole member. However, it still may be desirable to overmold the structural member to improve the adhesion of the structural member to the first molding material by sandwiching the structural member between two layers of molding material.

In another embodiment, the structural member can comprise a carbon fiber material with a thermosetting polymer on a top surface of the carbon fiber material. The thermosetting polymer can reduce the desirability of using another material to overmold the structural member by increasing the ability of the structural member to bond with other materials (e.g., the upper, etc.).

Figure 9:
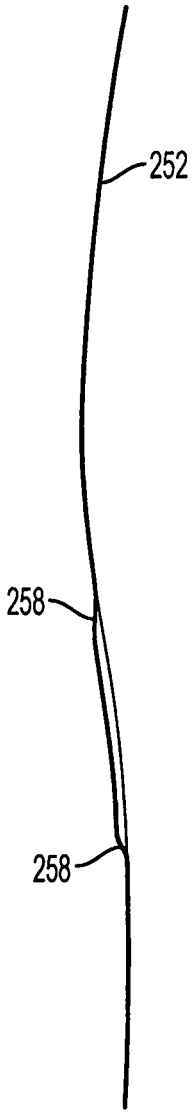
FIG. 9 is a side view of an embodiment of a structural member for use in a sole member.
Figure 10:
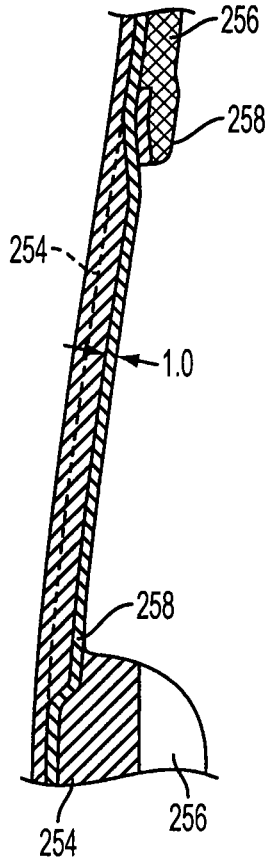
FIG. 10 is an expanded view of a cross-sectional area of a sole member having the structural member of FIG. 9.

FIGS. 9 and 10 illustrate an embodiment of a sole member 250 with a structural member 252 that is of a substantially uniform thickness. As shown in the side view of FIG. 9, structural member 252 is about 1 mm in thickness along its entire length. To provide additional structural integrity to sole member 252, structural member 252 can have at least one bend or curve along its length. As shown in FIG. 10, structural member 252 extends or bridges between a heel portion 254 and a forefoot portion 256. At or about the areas where structural member 252 contacts heel portion 254 and/or forefoot portion 256, structural member bends or curves, creating an offset portion. Because of the properties of carbon fiber (or other like materials), these curvature or bending areas 258 can provide increased stiffness and structural integrity to sole member 250.

FIGS. 11A-11J illustrate another embodiment of a structural member 260 for use with an injection molded sole member 280 (FIGS. 12A-12E). Structural member 260 is generally similar to structural member 220 (FIGS. 7A-7H). For convenience, where similar elements are presented in multiple embodiments herein, those similar elements may not be described in detail in each embodiment. Thus, because the form and structure of structural member 220 and sole member 230 generally overlap with the form and structure of structural member 260 and sole member 280, those same or similar elements may not be described in detail again.

Structural member 260 extends substantially the length of the sole member and comprises a plurality of openings 262 and at least one cut-away portion 264. Structural member 260 is of a generally constant thickness (e.g., about 1 mm thick). Structural member 260 comprises a plurality of curving surfaces 266 and cavities (e.g., grooves, wells, and/or indentations) 268 that provide a varying cross-sectional profile.

Figure 11D:
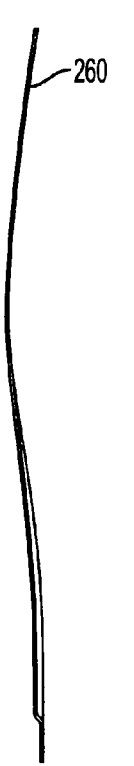
FIGS. 11A-11J are a plurality of views of an embodiment of a structural member for use in a sole member.
Figure 11C:
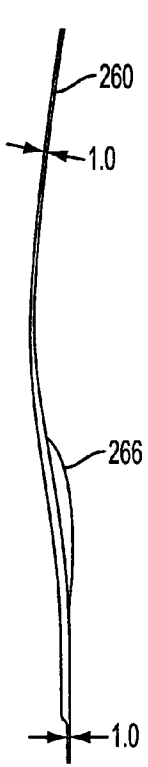
Figure 11B:
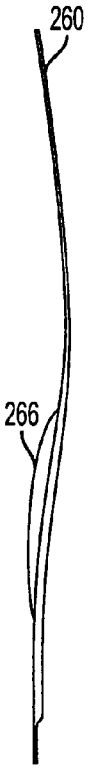
Figure 11A:
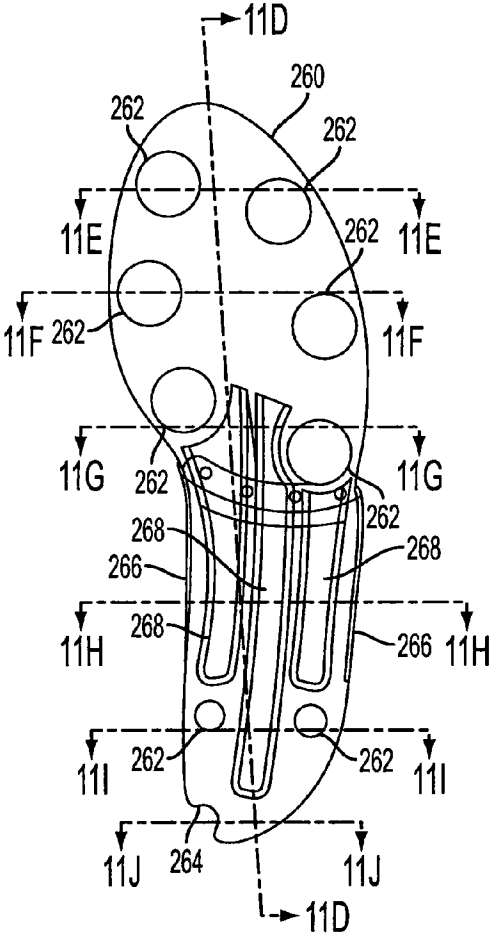
Figure 11G:
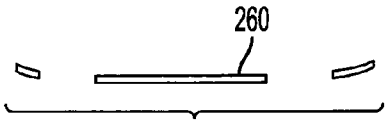
Figure 11F:
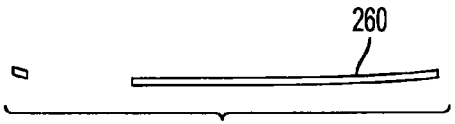
Figure 11E:
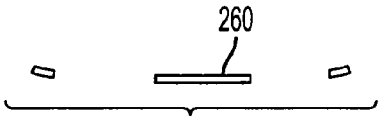
Figure 11J:
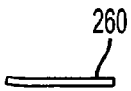
Figure 11I:
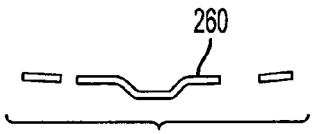

Referring to FIG. 11A, three cavities 268 extend along the length of structural member 260. Preferably, these cavities 268 extend at least in the area of a bridging portion 270 (FIG. 12A) that extends or bridges between a heel portion 272 and a forefoot portion 274. Thus, as shown in the cross-sectional view of FIG. 11H, structural member 260 can have an undulating cross-sectional profile along bridging portion 270 resulting from curving surfaces 266 and cavities 268. These curving surfaces 266 and/or cavities 268 provide increased stiffness and structural integrity over bridging portion 270 where significant forces are imparted to the sole member 260 when a shoe having sole member 260 is in use.

As shown in FIG. 11A, three cavities 268 can be provided. A central cavity 268 can extend into the forefoot portion 272 (as best seen in FIG. 12E). If the sole member comprises openings 262 (and corresponding receptacles), the central cavity can extend between at least two of the openings 262 (and corresponding receptacles) to provide additional rigidity further into the forefoot portion 272.

Figure 11H:
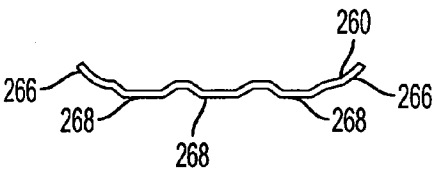

As best seen in FIGS. 11B, 11C, and 11H, structural member 260 can comprise curving surfaces 266 that extend upward at the medial and lateral edges of structural member 260. These curving surfaces 266 can further provide improved lateral stability to sole member 280 by creating a 3-dimensional cross-sectional profile (FIG. 11H).

FIGS. 12A-12K illustrate various views of sole member 280, which comprises at least a first molding material and structural member 260. Referring to cross-sectional view 12B, it can be seen that the thickness of structural member 260 is substantially constant along the length of the sole member 280. To reduce the profile of a shoe as much as possible without sacrificing the requisite rigidity of the sole member, the thickness of structural member 260 is preferably less than about 3 mm, more preferably less than about 2 mm, and more preferably less than about 1.5 mm.

Figure 12C:
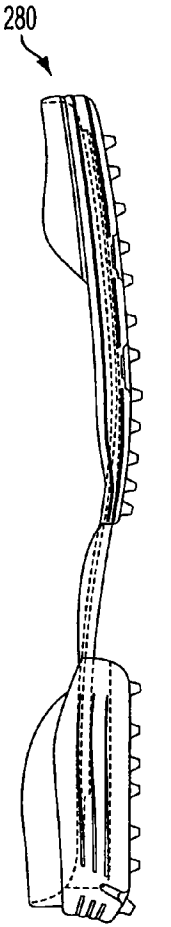
FIGS. 12A-12K are a plurality of views of an embodiment of a sole member having the structural member of FIGS. 11A-11J.
Figure 12B:
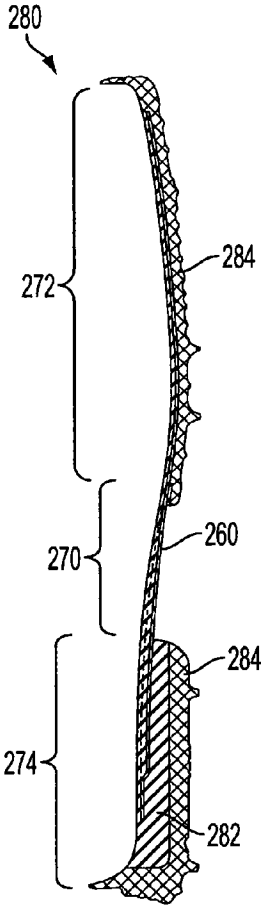
Figure 12A:
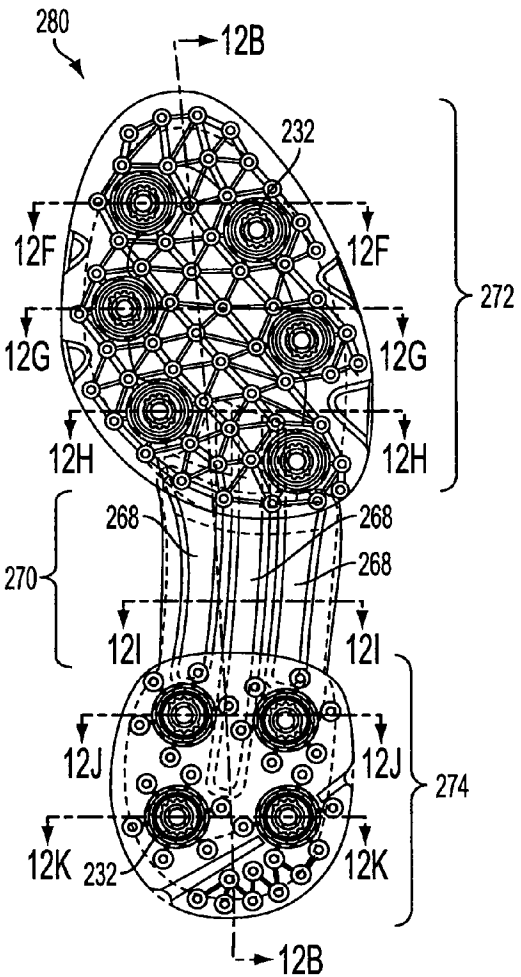
Figure 12E:
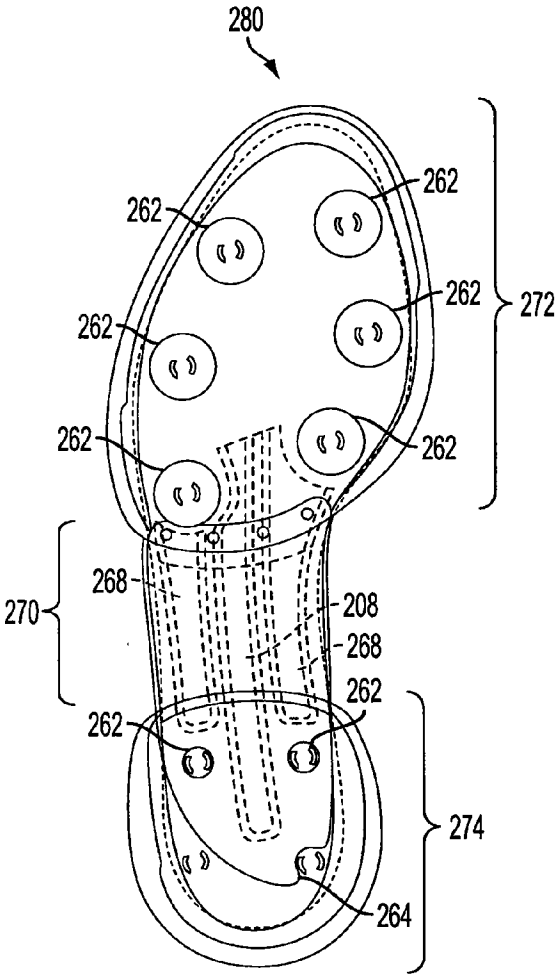
Figure 12D:
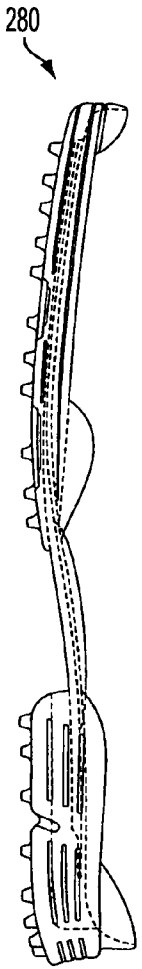

As shown in FIG. 12B, structural member 260 can curve or bend in the longitudinal direction to increase its rigidity. Such curves, bending, and/or cavities (FIG. 12E) can be particularly helpful to maintain the structural rigidity of the sole member when the structural member has a thickness of less than 3 mm. Thus, as shown in the heel portion 274, structural member 280 can bend or curve so that at least a portion of the length of structural member 280 is offset from another portion of the length of structural member.

FIG. 12B illustrates the use of multiple injections of molding material. For example, sole member 280 can comprise a first molding material 282 injected in a first step and a second molding material 284 injected in a second step. In FIG. 12B, the first and second molding materials 282, 284 can be distinguished by the different types of cross-hatching in the sectional view. Preferably, the first and second molding materials comprise the same material to increase bonding strength between the two layers of material; however, it should be understood that different molding materials could be used, provided that they adhere to one another as may be necessary depending on the application.

As will be understood by one of ordinary skill in the art, the sole members described herein can be molded in a variety of manners to produce the sole members shown and described herein. For example, each of the structural members described herein can be placed into a mold and at least a first molding material can be injected to form the shapes of the sole members described herein. An exemplary method for molding sole member 280 is described below.

Figure 13D:
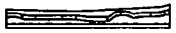
FIGS. 13A-13E are a plurality of views of an embodiment of a sole member having a plurality of openings for receiving molding materials via pinpoint mold gates.
Figure 13E:
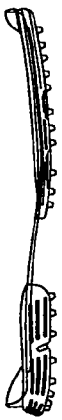
Figure 13C:
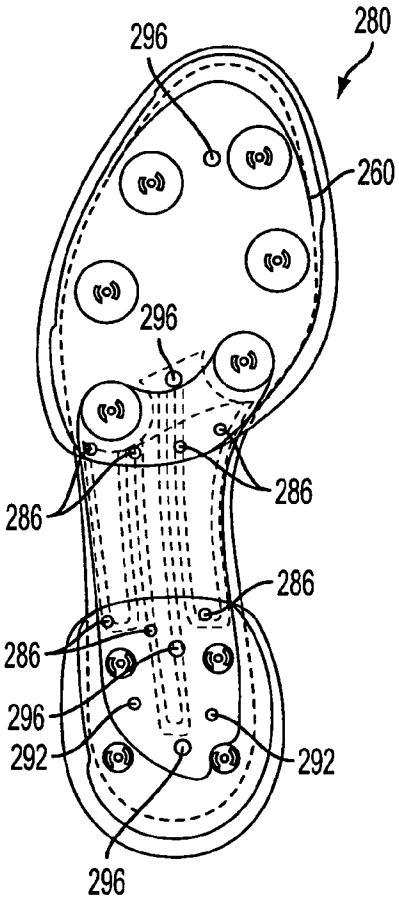
Figure 13B:
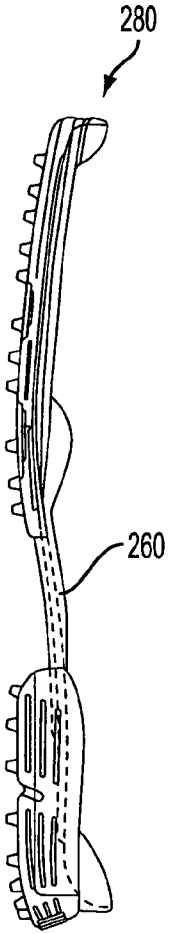
Figure 13A:
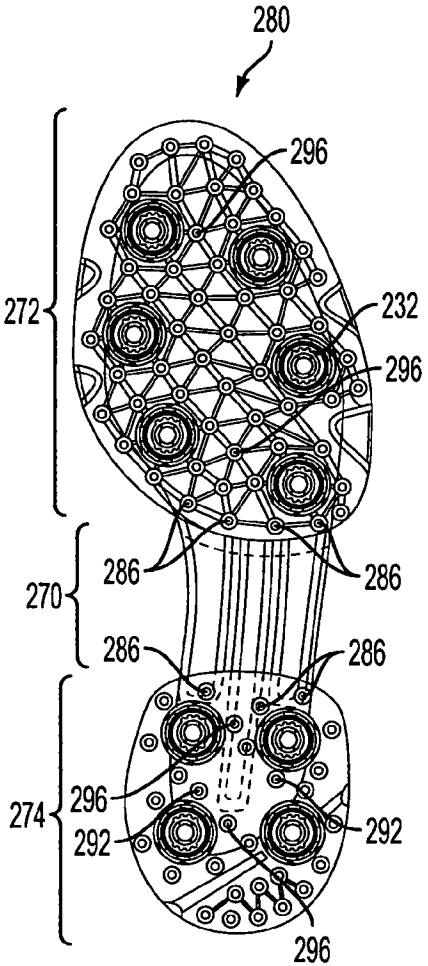
Figure 14:
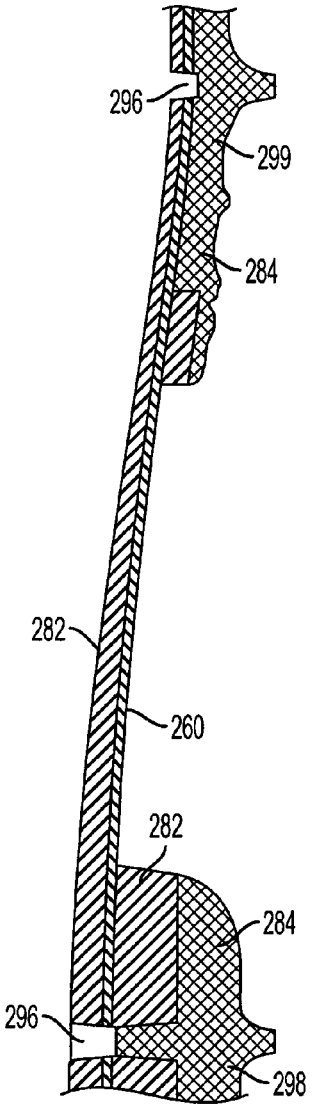
FIG. 14 is an enlarged cross-sectional view of the sole member of FIGS. 13A-13E.
Figure 15:
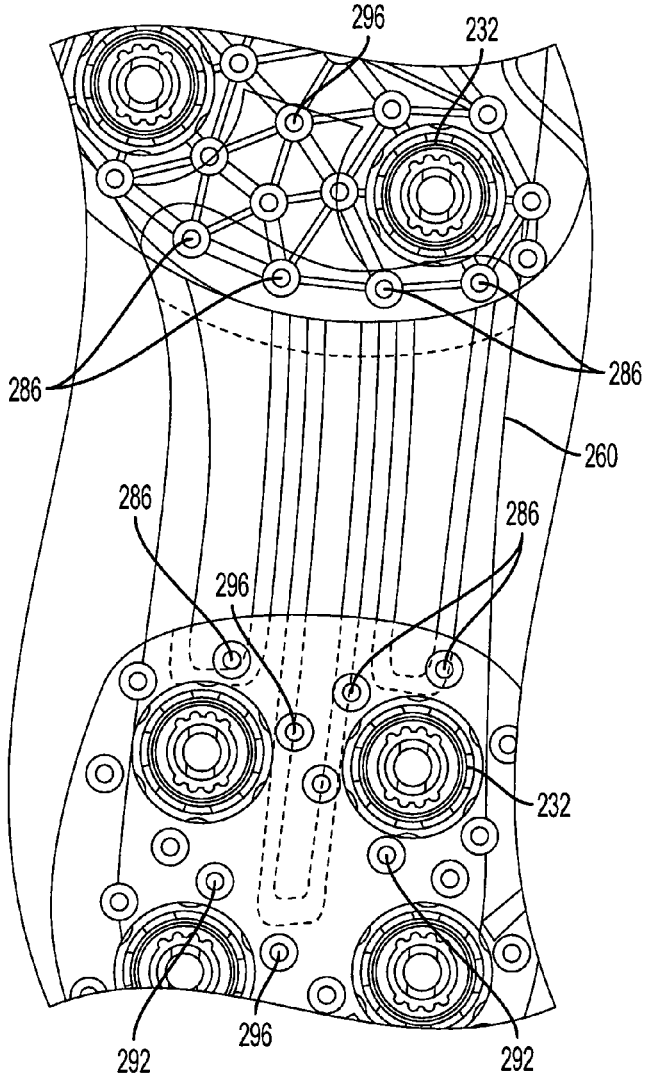
FIG. 15 is a partial bottom view of the sole member of FIGS. 13A-13E.

FIG. 13A is a bottom view of sole member 280, FIG. 13B is a side view of sole member 280, and FIG. 13C is a top view. FIG. 14 is an enlarged view of a cross-sectional of sole member 280 and FIG. 15 is an enlarged view of a portion of FIG. 13A. Referring to FIGS. 13A and 13C, structural member 260 comprises a plurality of holes extending therethrough. Some of these holes can be provided to achieve better bonding of the molded material to structural member 260. For example, holes 286 extend through structural member 260 to increase bonding of first molding material 282 between structural member 260 and the layer of first molding material 282 above structural member 260 and the layer of first molding material 284 below structural member 260. Holes 286 can be located along the length of structural member 260; however, holes 286 are preferably located at least adjacent areas where bridging portion 270 of structural member 260 meets heel portion 274 and/or forefoot portion 272. Although seven holes 286 are shown in FIGS. 13A and 13C, it should be understood that the number of holes 286 can vary, and more or less than seven holes could be provided.

As described below, structural member 260 can have other holes extending therethrough to facilitate delivery of the molding material though structural member 260. Such holes in the structural member permit the formation of the lower structure of the sole member. For example, in this embodiment, a first molding material and a second molding material can be delivered in different steps to ultimately form a single, integrated sole member.

Figure 16:
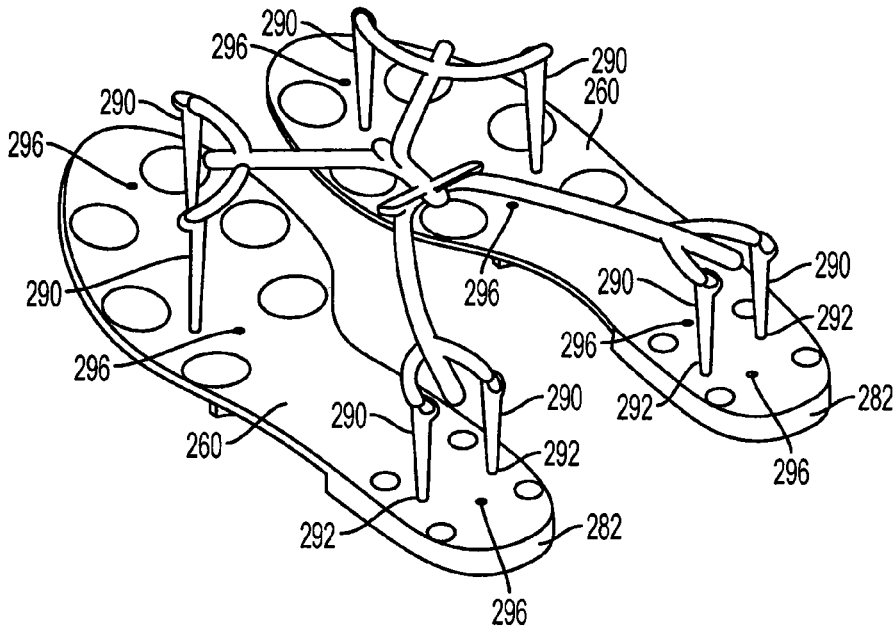
FIG. 16 illustrates a first injection molding step in a molding procedure for forming a sole member.

FIG. 16 illustrates a perspective view of a pin point gate arrangement for injecting first molding material 282 into a mold (not shown). As shown in FIG. 16, a plurality of pin point gates 290 are configured to deliver the first molding material 282 to the sole member at locations of first injection holes 292 which extend through structural member 260. In this manner, first molding material 282 can be delivered beneath structural member 260 at the locations shown in FIG. 12B.

In addition, the first molding material 282 preferably overmolds at least a portion of the top of structural member 260. By covering the top of structural member 260 (or at least a portion of the top) as shown in FIG. 12B, sole member 280 may be more easily joined or coupled to an upper or other member to finalize the shoe construction. To cover the top of the structural member 260, the first molding material 282 can be delivered through the pin point gates 290 under structural member 260 and the first molding material can flow above structural member 260 through holes 286 or other similar openings or areas that are fluidly connected to the top surface of structural member 260. For convenience, holes 286 are not shown in FIGS. 16 and 17; however, FIGS. 13A and 13C illustrate exemplary locations of holes 286 in structural member 260.

After the first molding step and the formation of an intermediate member comprising the first molding material and the structural member, the intermediate member can be removed from the first mold and positioned in a second mold for injecting a second molding material to complete the sole member.

Figure 17:
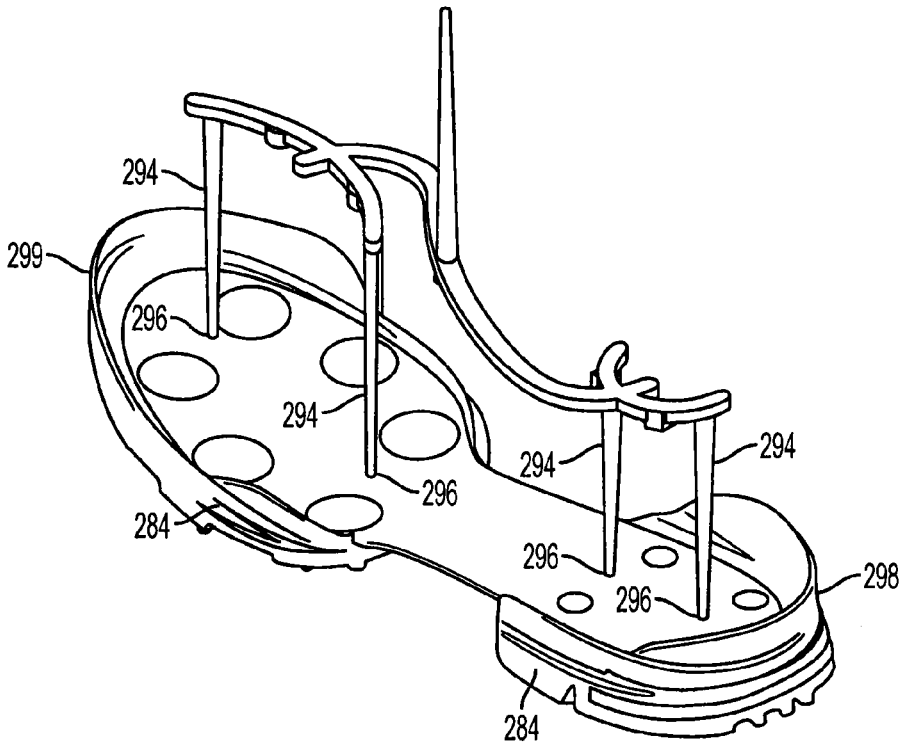
FIG. 17 illustrates a second injection molding step in a molding procedure for forming a sole member.

FIG. 17 illustrates a perspective view of a pin point gate arrangement for injecting second molding material 284 into a mold (not shown) in a second molding step. As shown in FIG. 17, a plurality of pin point gates 294 are configured to deliver the second molding material 284 to the sole member at locations of a plurality of second injection holes 296 which extend through structural member 260. In this manner, second molding material 284 can be delivered beneath structural member 260 at the locations shown in FIG. 12B. In a preferred embodiment, the first injection step provides the first molding material 282 on a top surface of the structural member 260; however, for convenience, the overmolding of first molding material 282 is not depicted in FIG. 17. Instead, for clarity, structural member 260 is shown in FIG. 17 without a layer of first molding material 282 on a top surface of structural member 260.

FIG. 14 shows an enlarged view of two of the plurality of second injection holes 296. As shown in FIG. 14, the second molding material 284 passes through holes 296 and forms an outsole heel member 298 and an outsole forefoot member 299. As shown in FIG. 17, the second molding material 284 can form a structure that wraps or extends above the height of the structural member to form outsole heel member 298 and outsole forefoot member 299.

Upon completion of the second molding step, sole member 280 can be removed from the mold and a shoe (e.g., a golf shoe) can be constructed using sole member 280 using convention methods for attaching an upper to a sole member.

Figure 12F:
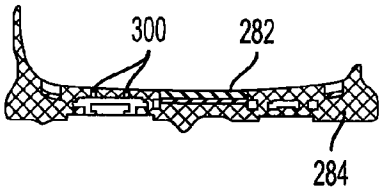
Figure 12G:
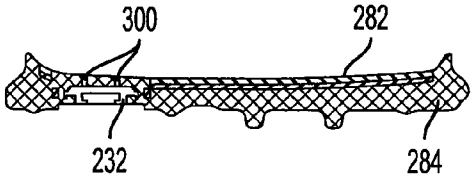
Figure 12H:
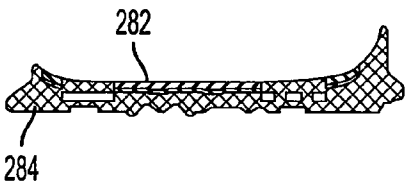
Figure 12I:
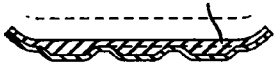
Figure 12J:
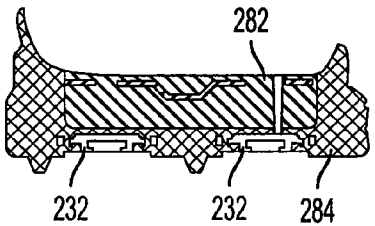
Figure 12K:
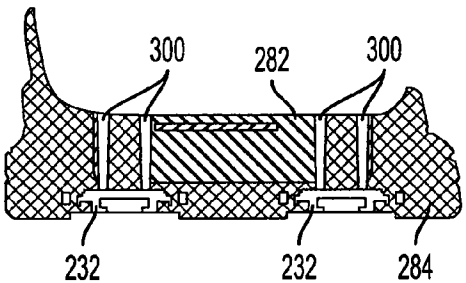

As discussed above in detail, the sole member preferably includes receptacles for receiving cleats or other gripping members. Such receptacles 232 are preferably held in position during the molding process using pins or other structural supports or restraints. As discussed above, openings 262 are preferably aligned with the location where receptacles 232 will be positioned. Accordingly, pin (not shown) or other structural supports or restraints can extend through openings 262 during the molding process to secure the receptacles in position relative to the first molding material, the structural member and the second molding material. FIGS. 12F, 12G, and 12K, for example, show openings or support holes 300 left behind from the presence of the plurality of restraint members (e.g., pins) that passed through the openings 262 of structural member 260 and held the receptacles 232 in position during the molding process.

As discussed above, other shapes and variations of the structural member are possible. For example, by varying the 3-dimensional geometry of the structural member, different amounts of rigidity and flexibility can be achieved along the longitudinal length of the structural member. Thus, as shown in FIGS. 11A and 11H, for example, the structural member can be curved or undulating to create a greater stiffness of the structural member at areas where increased strength is desired. Alternatively, where less stiffness is required (or greater flexibility desired) such as in the toe areas, the structural member can be substantially flat or flatter than those areas where greater stiffness is desired. Similarly, more or less material can be used to form the structural member to alter the flexibility and stiffness of the structural member. In other words, the amount (area) of structural material along any cross-sectional area can affect the stiffness of the structural member in that area. Thus, openings or cut-away portions formed in the structural member can reduce the stiffness of the structural member in those areas.

Figures 18A, 18B, 18C, 18D, 18E:
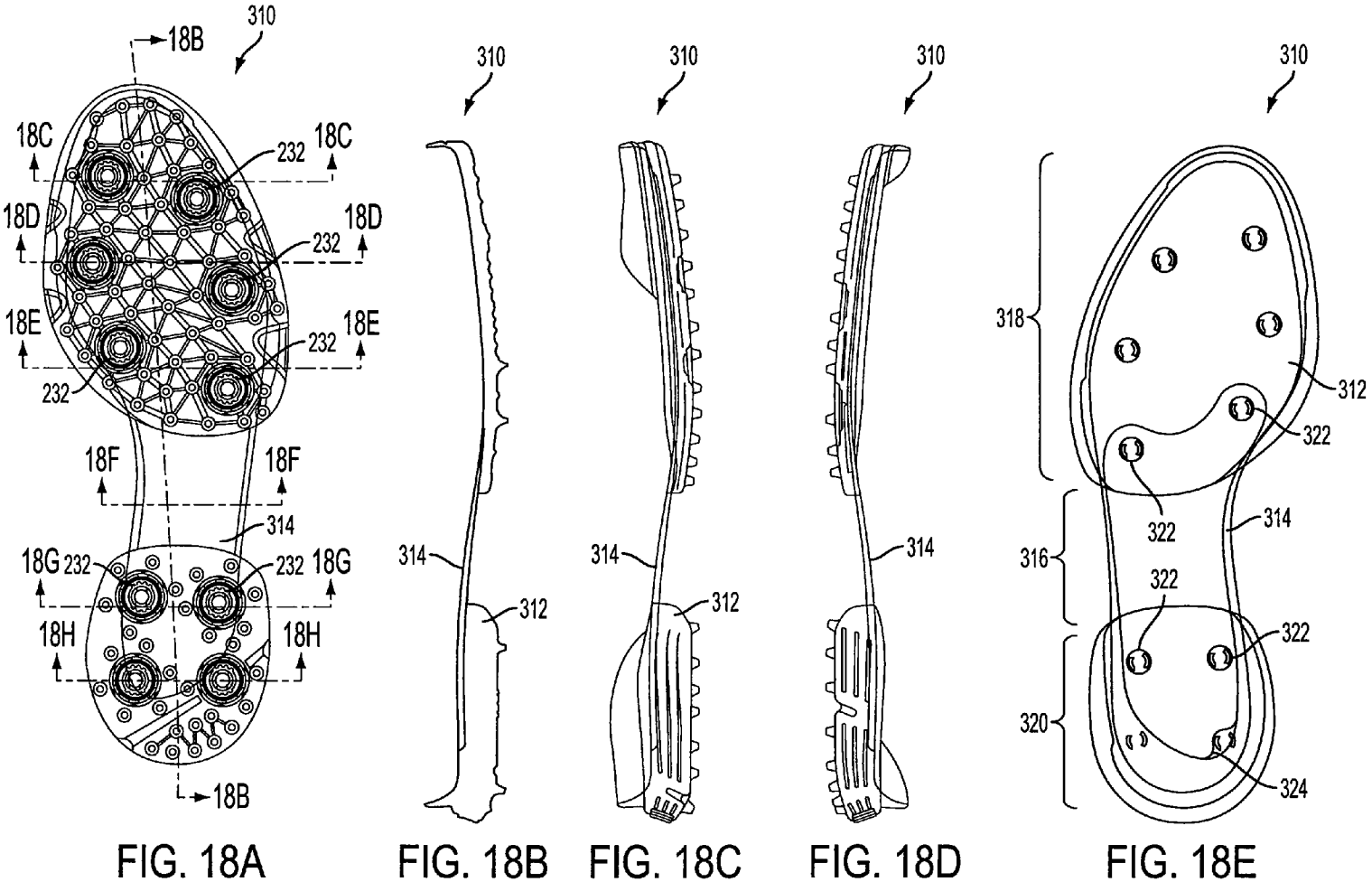
FIGS. 18A-18E are a plurality of views of an embodiment of a sole member having a structural member.

FIGS. 18A-18E illustrate a sole member 310 comprising at least a first molding material 312 and a structural member 314. As best seen in FIG. 18E, structural member 314 does not extend substantially the length of sole member 310. Instead, structural member 314 extends less than about 75% of the length of sole member 310. Structural member is configured to span the bridging portion 316 and extends only partially into forefoot portion 318 and heel portion 320.

As shown in FIG. 18E, a plurality of openings 322 are formed in structural member 314 for alignment with receptacles 232. However, because structural member 314 is shorter than the structural members of some of the other embodiments, it requires fewer openings 322. That is, since structural member 314 is shorter, it does not vertically overlap with as many of the receptacles 232 as was the case in other embodiments with a longer structural member. Structural member 314 can comprise one or more cut-away portions 324 in the heel (or elsewhere) to allow for access to the receptacle during molding (for the reasons discussed above).

Figure 19C:
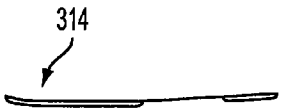
FIGS. 19A-19F are a plurality of views of the structural member of FIGS. 18A-18E.
Figure 19D:
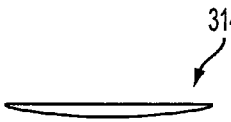
Figure 19E:
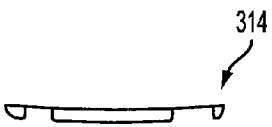
Figure 19F:
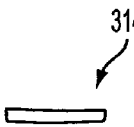
Figure 19B:
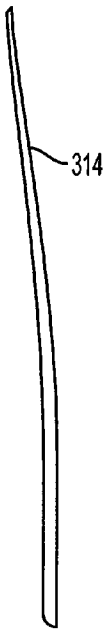
Figure 19A:
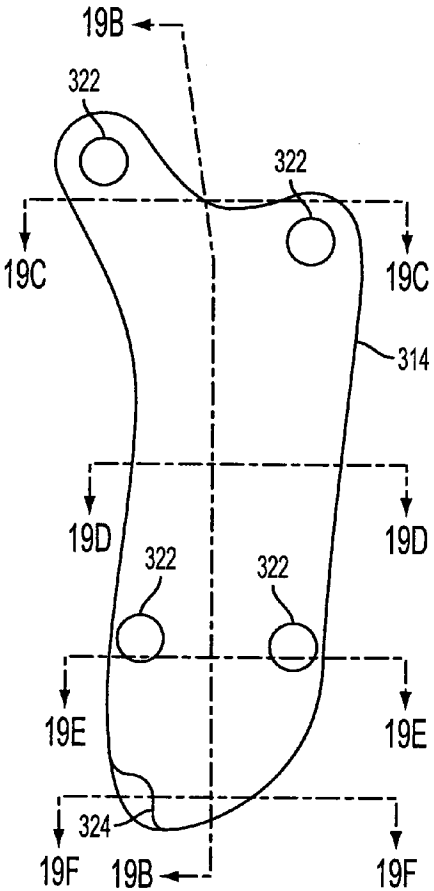
Figure 20C:
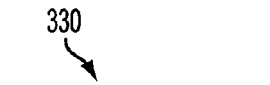
FIGS. 20A-20E are a plurality of views of an embodiment of a structural member for use in a sole member.
Figure 20D:
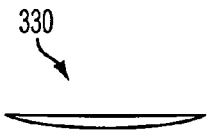
Figure 20E:
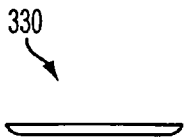
Figure 20B:
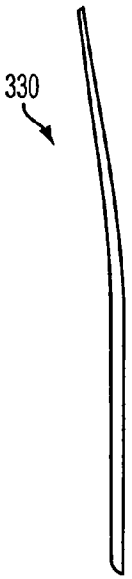
Figure 20A:
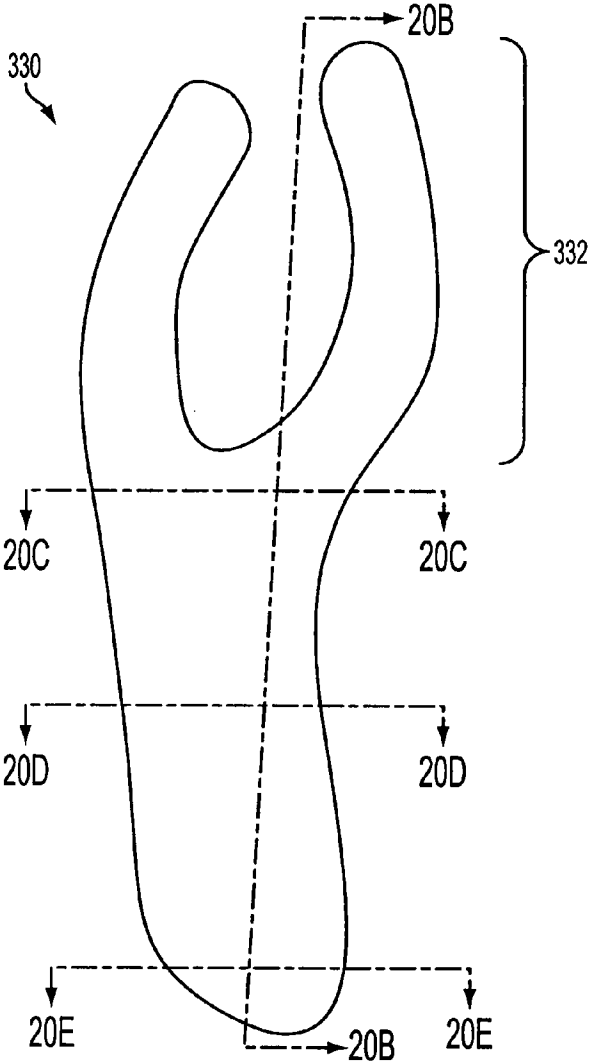

Referring to FIGS. 19B and 19D, structural member 314 can be of varying thickness along its length (FIG. 19B) and have a slight curvature along its width (FIG. 19D). Alternatively, structural member 314 can be of the substantially same thickness along the length and/or have a varying 3-dimensional cross-sectional profile in the manners described in other embodiments herein.

In another embodiment, the structural member can be decoupled in the forefoot area. Thus, as shown in FIGS. 20A-20E, structural member 330 extends substantially along the length of a sole member, but has a decoupled forefoot section 332. Decoupled section 332 provides for greater flexibility between a lateral side and medial side of the forefoot. This can be particularly advantageous when provided in a golf shoe. During a golf swing, a golfer must shift the weight from one side to the other and the increased flexibility of the decoupled portion of the structural member can help facilitate this movement.

Figure 21E:
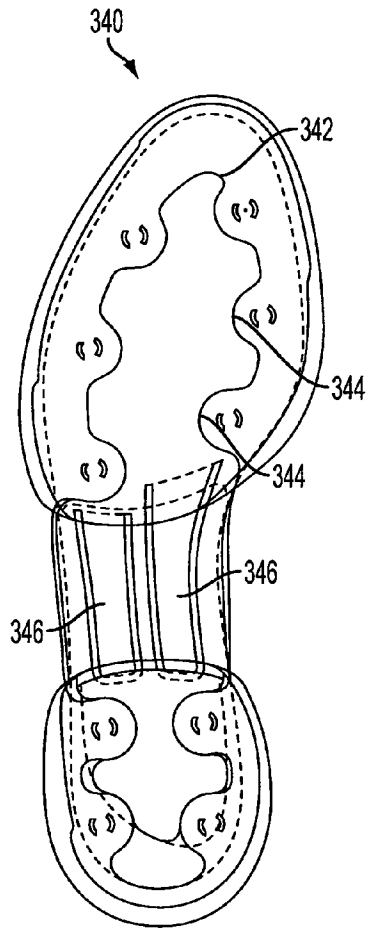
FIGS. 21A-21L are a plurality of views of an embodiment of a sole member having a structural member.
Figure 21D:
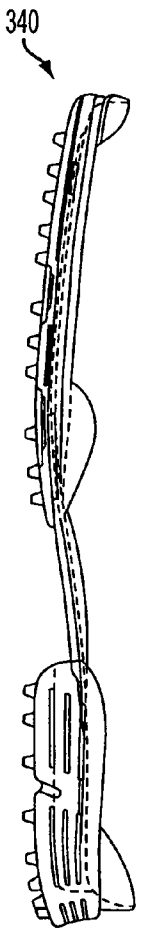
Figure 21C:
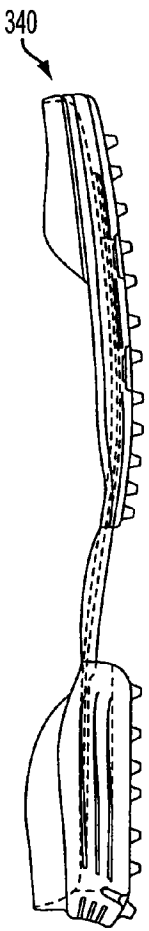
Figure 21B:
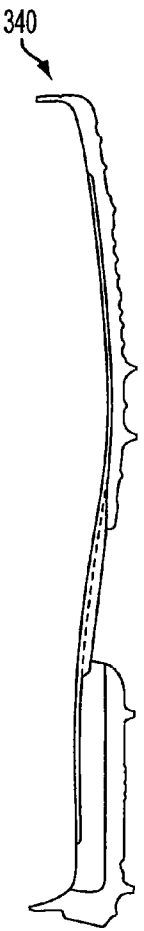
Figure 21A:
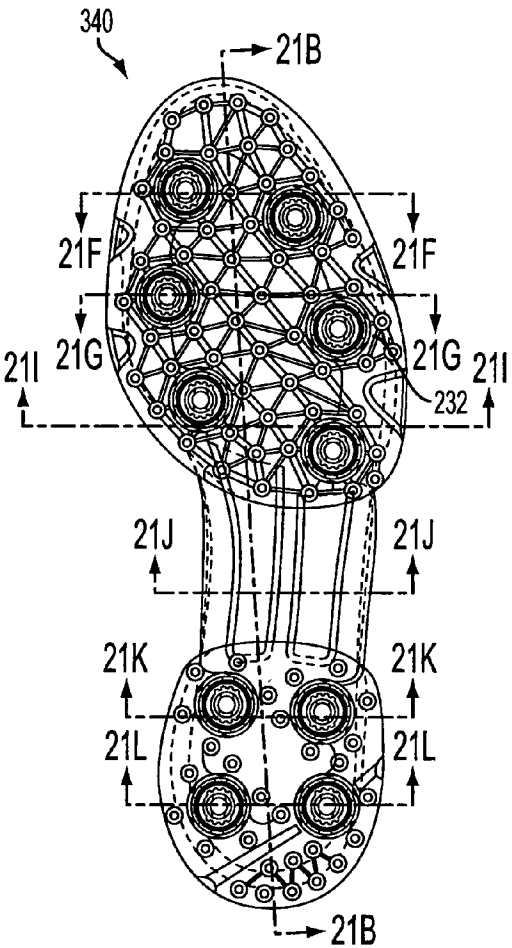
Figure 21F:
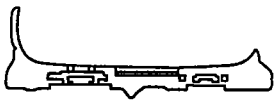
Figure 21G:
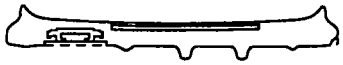
Figure 21H:
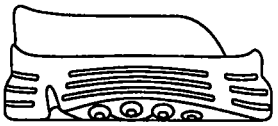
Figure 21I:
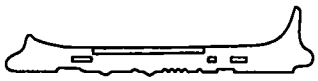
Figure 21J:
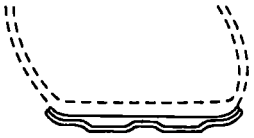
Figure 21K:
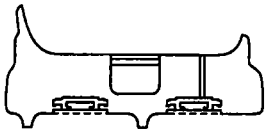
Figure 21L:
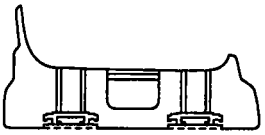

In another embodiment, a sole member 340 is provided with a structural member 342 that has a plurality of notched or cut-away portions 344 configured to be aligned with the receptacles 232 of sole member 340. As shown in FIG. 21E, each of the notched portions 344 are positioned so that structural member 342 does not cover the location of receptacles 232 during the molding process. In addition, as discussed in more detail above, structural member 342 comprises grooves (e.g., wells, concavities, or indentations) 346 that extend along at least a portion of the length of structural member 342. Grooves 346 provide a 3-dimensional profile in cross section (FIG. 22F) that provides an increased stiffness in the areas of the 3-dimensional cross-sectional profile.

As discussed above, the openings and notches (cut-away portions) provide access to the receptacles during the molding process so that the receptacles can be secured in the proper position during that process. However, as also discussed above, such openings or notches also alter the stiffness and flexibility of the structural member and can be provided solely for those reasons.

As described above in some embodiments, the molding material of the sole member can extend upward around the side of the structural member. In that manner, the molding material of the sole member can at least partially extend around the side of a user's foot when the shoe construction is completed and the shoe is in use. In addition or alternatively, it may be desirable to form the structural member so that it extends upwards at the side of the sole member to at least partially surround a user's foot when in use.

Figure 23:
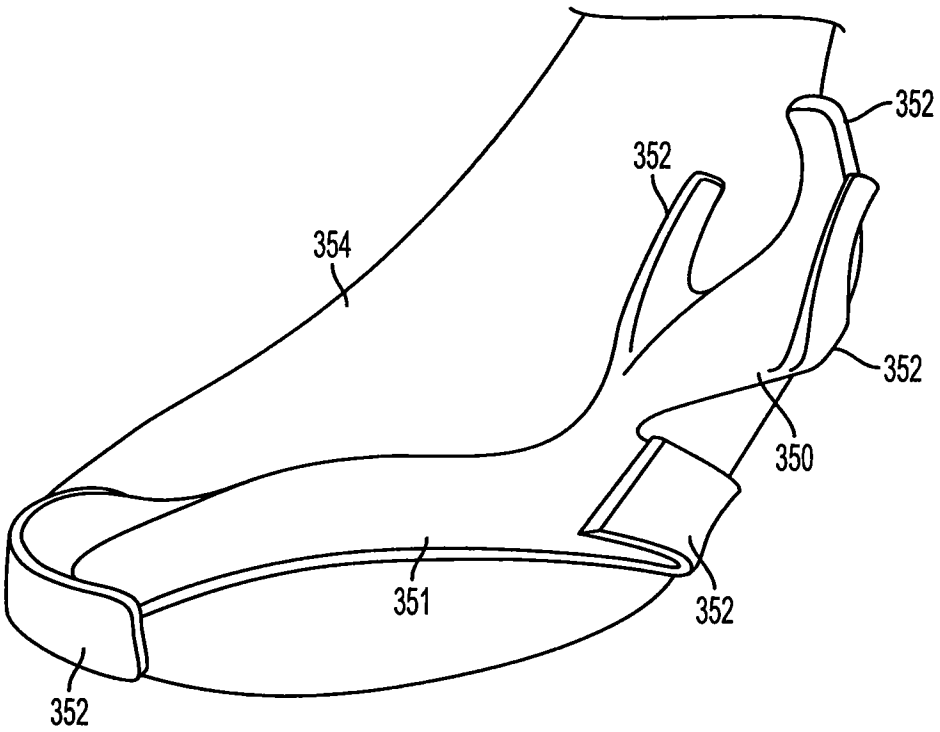
FIG. 23 is a perspective view of a structural member having a base portion and a plurality of upwardly extending portions
Figure 24:
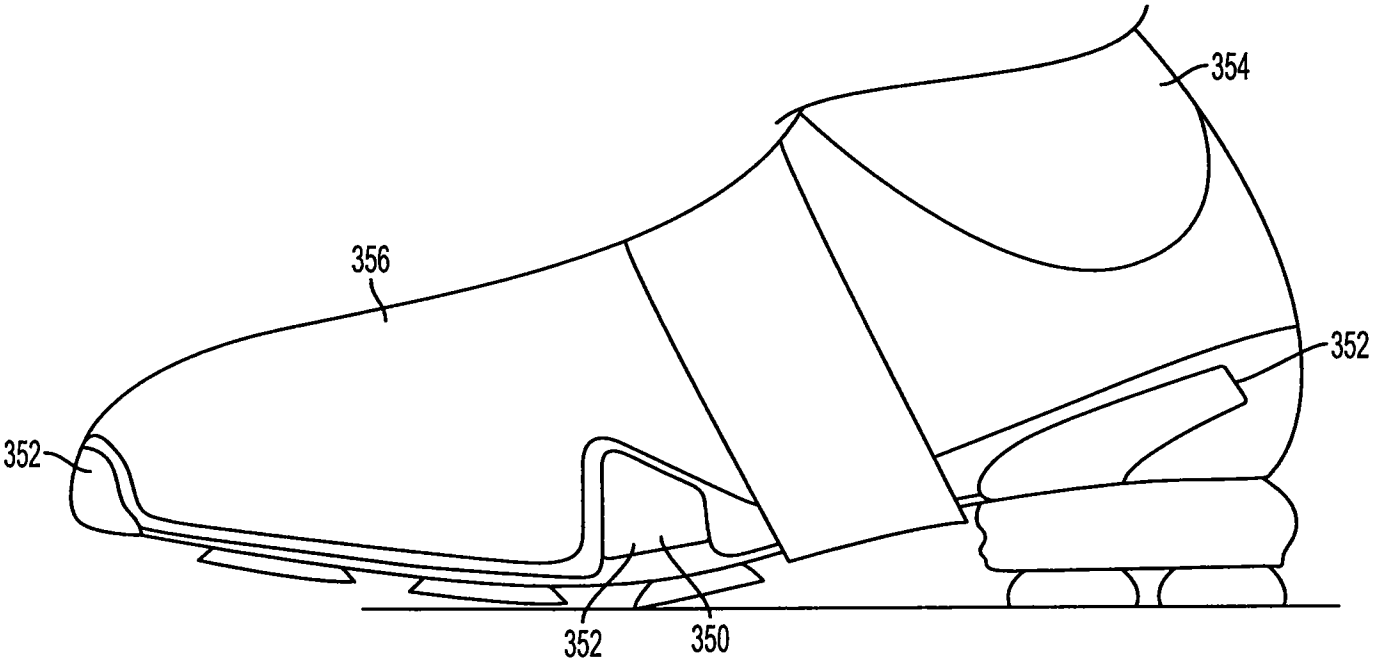
FIG. 24 is a side view of a shoe having the structural member of FIG. 23.

FIGS. 23 and 24 illustrate a schematic view of a structural member 350 that has portions or areas that extend upward and at least partially around a user's foot 354 when the shoe is in use. The molding material and other shoe parts (e.g., the upper) are excluded from FIG. 23 for clarity. In particular, FIG. 23 illustrates a structural member 350 that has a base portion 351 and a plurality of upwardly extending portions 352 that at least partially surround the sides of foot 354. Upwardly extending portions can be located in various areas, including, for example, on the rear side of the heel, the sides of the heel, at the lateral side, at the medial side (not shown), and at the front toe section.

Referring to FIG. 24, an upper 356 can be coupled to sole member 350 in any conventional manner. If desired, as shown in FIG. 24 at least some of the upwardly extending portions 352 of structural member 350 can be exposed.

Although many of the embodiments herein describe at least a portion of the structural member being exposed (at least on a bottom surface of the sole member), it should be understood that the structural member in each embodiment could be completely covered by the first molding material, without significantly altering the functionality of the structural member. Alternatively, additional and/or other portions of the structural member could be exposed at various areas of the sole member, depending on the shape and structure of the shoe.

In embodiments, that have a decoupled heel and forefoot construction (i.e., a bridging portion connecting heel and forefoot portions), the vast majority of the rigidity and strength of the shank area (e.g., bridging portion) comes from the structural member. Thus, the structural member must be sufficiently rigid to support an individual's weight (e.g., up to 250 lbs or greater). In those embodiments, the structural member should be able to provide sufficient vertical support to the sole member as well as torsion stability to restrict both inversion and eversion of the sole member during use.

As described above, the structural member is preferably formed of a carbon fiber material, such as a fabric made of woven carbon filaments. Carbon fiber materials are particularly desirable because they can be formed in various shapes that provide a relatively low profile (e.g., thin) structural member, which can help reduce the distance that a user is raised off the ground without sacrificing the structural strength and integrity of the shoe.

Other polymeric materials generally considered useful for making the structural member can include, without limitation, synthetic and natural rubbers, thermoset polymers such as other thermoset polyurethanes or thermoset polyureas, as well as thermoplastic polymers including thermoplastic elastomers such as metallocene catalyzed polymer, unimodal ethylene/carboxylic acid copolymers, unimodal ethylene/carboxylic acid/carboxylate terpolymers, bimodal ethylene/carboxylic acid copolymers, bimodal ethylene/carboxylic acid/carboxylate terpolymers, thermoplastic polyurethanes, thermoplastic polyureas, polyamides, copolyamides, polyesters, copolyesters, polycarbonates, polyolefins, halogenated (e.g. chlorinated) polyolefins, halogenated polyalkylene compounds, such as halogenated polyethylene [e.g. chlorinated polyethylene (CPE)], polyalkenamer, polyphenylene oxides, polyphenylene sulfides, diallyl phthalate polymers, polyimides, polyvinyl chlorides, polyamide-ionomers, polyurethane-ionomers, polyvinyl alcohols, polyarylates, polyacrylates, polyphenylene ethers, impact-modified polyphenylene ethers, polystyrenes, high impact polystyrenes, acrylonitrile-butadiene-styrene copolymers, styrene-acrylonitriles (SAN), acrylonitrile-styrene-acrylonitriles, styrene-maleic anhydride (S/MA) polymers, styrenic block copolymers including styrene-butadiene-styrene (SBS), styrene-ethylene-butylene-styrene, (SEBS) and styrene-ethylene-propylene-styrene (SEPS), styrenic terpolymers, functionalized styrenic block copolymers including hydroxylated, functionalized styrenic copolymers, and terpolymers, cellulosic polymers, liquid crystal polymers (LCP), ethylene-propylene-diene terpolymers (EPDM), ethylene-vinyl acetate copolymers (EVA), ethylene-propylene copolymers, propylene elastomers (such as those described in U.S. Pat. No. 6,525,157, to Kim et al, the entire contents of which is hereby incorporated by reference in its entirety), ethylene vinyl acetates, polyureas, and polysiloxanes and any and all combinations thereof.

One preferred material which may be used as a component of the structural member comprises a blend of an ionomer and a block copolymer. Examples of such block copolymers include styrenic block copolymers including styrene-butadiene-styrene (SBS), styrene-ethylene-butylene-styrene, (SEBS) and styrene-ethylene/propylene-styrene (SEPS). Also included are functionalized styrenic block copolymers, including those where the block copolymer incorporates a first polymer block having an aromatic vinyl compound, a second polymer block having a conjugated diene compound and a hydroxyl group located at a block copolymer, or its hydrogenation product, and in which the ratio of block copolymer to ionomer ranges from 5:95 to 95:5 by weight, more preferably from about 10:90 to about 90:10 by weight, more preferably from about 20:80 to about 80:20 by weight, more preferably from about 30:70 to about 70:30 by weight and most preferably from about 35:65 to about 65:35 by weight. A preferred functionalized styrenic block copolymer is SEPTON HG-252. Such blends are described in more detail in commonly-assigned U.S. Pat. No. 6,861,474 and U.S. Patent Publication No. 2003/0224871 both of which are incorporated herein by reference in their entireties.

Another preferred material for either the structural member is a composition prepared by blending together at least three materials, identified as Components A, B, and C, and melt processing these components to form in situ, a polymer blend composition incorporating a pseudo crosslinked polymer network. Such blends are described in more detail in commonly-assigned U.S. Pat. No. 6,930,150, to Kim et al, the content of which is incorporated by reference herein in its entirety. Component A is a monomer, oligomer, prepolymer or polymer that incorporates at least five percent by weight of at least one type of an acidic functional group. Examples of such polymers suitable for use as include, but are not limited to, ethylene/(meth)acrylic acid copolymers and ethylene/(meth)acrylic acid/alkyl(meth)acrylate terpolymers, or ethylene and/or propylene maleic anhydride copolymers and terpolymers. Examples of such polymers which are commercially available include, but are not limited to, the Escor® 5000, 5001, 5020, 5050, 5070, 5100, 5110 and 5200 series of ethylene-acrylic acid copolymers sold by Exxon and the PRIMACOR® 1321, 1410, 1410-XT, 1420, 1430, 2912, 3150, 3330, 3340, 3440, 3460, 4311, 4608 and 5980 series of ethylene-acrylic acid copolymers sold by The Dow Chemical Company, Midland, Mich. and the ethylene-acrylic acid copolymers Nucrel 599, 699, 0903, 0910, 925, 960, 2806, and 2906 ethylene-methacrylic acid copolymers sold by DuPont Also included are the bimodal ethylene/carboxylic acid polymers as described in U.S. Pat. No. 6,562,906, the contents of which are incorporated herein by reference. These polymers comprise ethylene/α,β-ethylenically unsaturated C3-8 carboxylic acid high copolymers, particularly ethylene (meth)acrylic acid copolymers and ethylene, alkyl(meth)acrylate, (meth) acrylic acid terpolymers, having molecular weights of about 80,000 to about 500,000 which are melt blended with ethylene/α,β-ethylenically unsaturated C3-8 carboxylic acid copolymers, particularly ethylene/(meth)acrylic acid copolymers having molecular weights of about 2,000 to about 30,000.

Component B can be any monomer, oligomer, or polymer, preferably having a lower weight percentage of anionic functional groups than that present in Component A in the weight ranges discussed above, and most preferably free of such functional groups. Examples of materials for use as Component B include block copolymers such as styrenic block copolymers including styrene-butadiene-styrene (SBS), styrene-ethylene-butylene-styrene, (SEBS) and styrene-ethylene/propylene-styrene (SEPS). Also included are functionalized styrenic block copolymers, including those where the block copolymer incorporates a first polymer block having an aromatic vinyl compound, a second polymer block having a conjugated diene compound and a hydroxyl group located at a block copolymer, or its hydrogenation product. Commercial examples SEPTON marketed by Kuraray Company of Kurashiki, Japan; TOPRENE by Kumho Petrochemical Co., Ltd and KRATON marketed by Kraton Polymers.

Component C is a base capable of neutralizing the acidic functional group of Component A and is a base having a metal cation. These metals are from groups IA, IB, IIA, IIB, IIIA, IIIB, IVA, IVB, VA, VB, VIA, VIB, VIIB and VIIIB of the periodic table. Examples of these metals include lithium, sodium, magnesium, aluminum, potassium, calcium, manganese, tungsten, titanium, iron, cobalt, nickel, hafnium, copper, zinc, barium, zirconium, and tin. Suitable metal compounds for use as a source of Component C are, for example, metal salts, preferably metal hydroxides, metal oxides, metal carbonates, or metal acetates.

The composition preferably is prepared by mixing the above materials into each other thoroughly, either by using a dispersive mixing mechanism, a distributive mixing mechanism, or a combination of these. These mixing methods are well known in the manufacture of polymer blends. As a result of this mixing, the anionic functional group of Component A is dispersed evenly throughout the mixture. Most preferably, Components A and B are melt-mixed together without Component C, with or without the premixing discussed above, to produce a melt mixture of the two components. Then, Component C separately is mixed into the blend of Components A and B. This mixture is melt-mixed to produce the reaction product. This two-step mixing can be performed in a single process, such as, for example, an extrusion process using a proper barrel length or screw configuration, along with a multiple feeding system.

Another preferred material which may be used as the structural member are the polyalkenamers which may be prepared by ring opening metathesis polymerization of one or more cycloalkenes in the presence of organometallic catalysts as described in U.S. Pat. Nos. 3,492,245, and 3,804,803, the entire contents of both of which are herein incorporated by reference. Examples of suitable polyalkenamer rubbers are polybutenamer rubber, polypentenamer rubber, polyhexenamer rubber, polyheptenamer rubber, polyoctenamer rubber, polynonenamer rubber, polydecenamer rubber polyundecenamer rubber, polydodecenamer rubber, polytridecenamer rubber. For further details concerning polyalkenamer rubber, see Rubber Chem. & Tech., Vol. 47, page 511-596, 1974, which is incorporated herein by reference. Polyoctenamer rubbers are commercially available from Huls AG of Marl, Germany, and through its distributor in the U.S., Creanova Inc. of Somerset, N.J., and sold under the trademark VESTENAMER®. Two grades of the VESTENAMER® trans-polyoctenamer are commercially available: VESTENAMER 8012 designates a material having a trans-content of approximately 80% (and a cis-content of 20%) with a melting point of approximately 54° C.; and VESTENAMER 6213 designates a material having a trans-content of approximately 60% (cis-content of 40%) with a melting point of approximately 30° C. Both of these polymers have a double bond at every eighth carbon atom in the ring.

The polyalkenamer rubber preferably contains from about 50 to about 99, preferably from about 60 to about 99, more preferably from about 65 to about 99, even more preferably from about 70 to about 90 percent of its double bonds in the trans-configuration. The preferred form of the polyalkenamer has a trans content of approximately 80%, however, compounds having other ratios of the cis- and trans-isomeric forms of the polyalkenamer can also be obtained by blending available products for use in making the composition.

The polyalkenamer rubber has a molecular weight (as measured by GPC) from about 10,000 to about 300,000, preferably from about 20,000 to about 250,000, more preferably from about 30,000 to about 200,000, even more preferably from about 50,000 to about 150,000. The polyalkenamer rubber has a degree of crystallization (as measured by DSC secondary fusion) from about 5 to about 70, preferably from about 6 to about 50, more preferably from about from 6.5 to about 50%, even more preferably from about from 7 to about 45%. A most preferable polyalkenamer rubber is a polyoctenamer.

One highly preferred polymer composition for use as the structural member are blends of the polyalkenamer rubbers with other polymers, and an especially preferred blend is that of a polyalkenamer and a polyamide. A more complete description of the polyalkenamer rubber blends are disclosed in U.S. Pat. No. 7,528,196 and copending U.S. application Ser. No. 12/415,522, filed on Mar. 31, 2009, both in the name of Hyun Kim et al., the entire contents of both of which are hereby incorporated by reference.

In view of the many possible embodiments to which the principles of the disclosed embodiments may be applied, it should be recognized that the illustrated embodiments are only preferred examples and should not be taken as limiting the scope of protection. Rather, the scope of the protection is defined by the following claims. We therefore claim all that comes within the scope and spirit of these claims.

We claim:

1. A golf shoe comprising:

a sole member having a length and which is integrally formed with a molding material, an integrated structural member formed within the molding material and which is completely covered by the molding material other than openings at the locations of a plurality of receptacles in the bottom of the sole member, each receptacle being configured to receive a cleat member, wherein the structural member extends substantially the length of the sole member and is configured to not vertically overlap with any of the receptacles, and wherein the structural member comprises carbon fiber or a thermoplastic polyamide elastomer.

2. The golf shoe of claim 1, wherein the structural member comprises a plurality of openings that extend therethrough, each opening being aligned with at least one receptacle.

3. The golf shoe of claim 1, wherein the structural member comprises a plurality of cut-away portions, each cut-away portions being adjacent to, but not covering, at least one receptacle.

4. The golf shoe of claim 1, wherein the structural member comprises one or more grooved portions that extend longitudinally along at least a portion of the length of the shoe, the one or more grooved portions causing the structural member to have a 3-dimensional cross-sectional profile along its width at the areas of the one or more grooved portions.

5. The golf shoe of claim 4, wherein the golf shoe comprises at least two grooved portions that extend longitudinally along at least a portion of the length of the shoe.

6. The golf shoe of claim 1, wherein the structural member curves upwards at its lateral and medial edges.

7. The golf shoe of claim 1, wherein the structural member comprises at least one upwardly extending member, the upwardly extending member extending above an insole of the shoe to at least partially surround a foot of a person wearing the shoe.

8. The golf shoe of claim 1, wherein the structural member extends less than 75% of the length of the sole member.

9. The golf shoe of claim 1, further comprising an upper secured to a top portion of the sole member.

10. The golf shoe of claim 1, wherein at least a portion of the structural member is exposed at the bottom of the sole member.

11. The golf shoe of claim 1, wherein the structural member comprises a bridging portion that extends between a heel portion and a forefoot portion.

12. The golf shoe of claim 1, wherein the structural member varies in thickness along its length.

13. The golf shoe of claim 1, wherein the structural member is substantially constant in thickness along its length.

14. The golf shoe of claim 1, wherein the structural member bends or curves along at least a portion of its length.

15. The golf shoe of claim 1, wherein the molding material is a thermoplastic polyurethane.

16. A sole member having a length formed and for use with a golf shoe comprising:

an integrated structural member which is completely covered by a molding material, the structural member extending along at least a portion of the length of the sole member and providing rigidity to the sole member; and the molding material completely surrounding the structural member, the molding material forming a heel portion and a forefoot portion of the sole member, wherein the structural member extends substantially the length of the sole member and between the heel and forefoot portions to couple the heel and forefoot portions together, and wherein the structural member comprises carbon fiber or a thermoplastic polyamide elastomer.

17. The sole member of claim 16, further comprising:

a plurality of receptacles positioned on a bottom of the sole member, each receptacle being configured for receiving a cleat member, wherein the structural member comprises a plurality of openings that extend therethrough, each opening being vertically aligned with at least one receptacle.

18. The sole member of claim 16, wherein the structural member comprises a plurality of cut-away portions, each cut-away portions being adjacent to, but not vertically overlapping, at least one receptacle.

19. The sole member of claim 16, wherein the structural member comprises one or more grooved portions that extend longitudinally along at least a portion of the length of the shoe, the one or more grooved portions causing the structural member to have a 3-dimensional cross-sectional profile along its width at the areas of the one or more grooved portions.

20. The sole member of claim 16, wherein the structural member curves upwards at its lateral and medial edges.

21. The sole member of claim 16, wherein the structural member comprises at least one upwardly extending member, the upwardly extending member extending above an upper surface of the molding material.

22. The sole member of claim 16, wherein the structural member extends less than 75% of the length of the sole member.

23. The sole member of claim 16, wherein at least a portion of the structural member is exposed at the bottom of the sole member.

24. The sole member of claim 16, wherein the structural member varies in thickness along its length.

25. The sole member of claim 16, wherein the structural member is substantially constant in thickness along its length.

26. The sole member of claim 16, wherein the structural member bends or curves along at least a portion of its length.

27. The sole member of claim 16, wherein the molding material is a thermoplastic polyurethane.

* * * * *